US011289297B1

(12) United States Patent
Burns et al.

(10) Patent No.: US 11,289,297 B1
(45) Date of Patent: Mar. 29, 2022

(54) TWO-PIECE FUSE ENDBELL WITH PRE-CAST/PRE-MOLDED ALIGNMENT SLOTS AND OPTIONAL INTERFACE CRUSH RIBS

(71) Applicant: Littelfuse, Inc., Chicago, IL (US)

(72) Inventors: David Arthur Burns, Chicago, IL (US); Jon Richard, Chicago, IL (US); Ganesh Nagaraj Chennakesavelu, Chicago, IL (US); Derek Lasini, Chicago, IL (US); Scott Faust, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/314,277

(22) Filed: May 7, 2021

(51) Int. Cl.
*H01H 85/143* (2006.01)
*H01H 85/165* (2006.01)

(52) U.S. Cl.
CPC ..... *H01H 85/143* (2013.01); *H01H 85/165* (2013.01)

(58) Field of Classification Search
CPC .... H01H 69/02; H01H 85/143; H01H 85/157; H01H 85/165; H01H 85/175; H01H 85/1755
See application file for complete search history.

(56) References Cited

U.S. PATENT DOCUMENTS

| | | | | |
|---|---|---|---|---|
| 4,949,062 | A * | 8/1990 | Mollet | H01H 85/153 337/248 |
| 4,972,170 | A * | 11/1990 | Ehlmann | H01H 85/153 337/158 |
| 5,296,832 | A * | 3/1994 | Perreault | H01H 85/153 337/158 |
| 2015/0348732 | A1* | 12/2015 | Douglass | H01H 69/02 337/198 |
| 2016/0141138 | A1* | 5/2016 | Schlaak | H01H 85/185 337/231 |
| 2016/0268089 | A1* | 9/2016 | Schlaak | H01H 85/185 |
| 2017/0084415 | A1* | 3/2017 | Nakanishi | H01H 85/08 |
| 2018/0061607 | A1* | 3/2018 | Schlaak | H01H 85/157 |
| 2018/0114663 | A1* | 4/2018 | Possnicker | H01H 85/0418 |
| 2018/0122606 | A1* | 5/2018 | Ando | H01H 85/143 |
| 2018/0174791 | A1* | 6/2018 | Kawai | H01H 85/185 |
| 2020/0234906 | A1* | 7/2020 | Rosios | H01H 85/157 |

* cited by examiner

*Primary Examiner* — Jacob R Crum
(74) *Attorney, Agent, or Firm* — Kacvinsky Daisak Bluni PLLC

(57) ABSTRACT

A novel fuse assembly design utilizes single-piece terminal assemblies and two-piece endbells. The two-piece endbells and terminal assembly feature mating elements that enable fastening of the endbell portions to the terminal assembly without use of adhesives. The mating elements also provide positioning guidance for ease of assembly. Slots in the endbells for receipt of insertion pins enable the endbells to be pre-cast/pre-molded without costly rework of molding tools.

19 Claims, 17 Drawing Sheets

200C

1100

1150

TWO-PIECE FUSE ENDBELL WITH PRE-CAST/PRE-MOLDED ALIGNMENT SLOTS AND OPTIONAL INTERFACE CRUSH RIBS

FIELD OF THE DISCLOSURE

Embodiments of the present disclosure relate to fuse assemblies, and, more particularly, to fuse assemblies having two-piece endbells.

BACKGROUND

Used in electrical systems to protect against excessive current, fuses are sacrificial devices which break when an overcurrent condition occurs. Fuses include a fuse element, such as a metal wire or strip, that links two metal contact terminals together, and which melts/breaks if too much current flows. The breakage causes an open circuit, thus protecting devices to which the fuse is connected. Fuses come in a variety of shapes and sizes and have many applications, from small circuit electronics to large-scale industrial applications. In addition to being a component protection device, fuses are also safety devices, such as when used in vehicles, as they protect against fires in response to vehicle accidents.

Some fuses may include endbells at either side of the fuse body, with a fuse element disposed in the fuse body. The endbells are designed to support and protect the fuse element from external forces and environmental stresses. The existing fuse technology utilizes two fully circular endbells, each of which is engaged such as by first press-fitting or brazing into its respective separate terminal before the fuse element is attached. This assembly method thus involves a secondary process, such as soldering or welding, to attach the fuse element between the two terminals, increasing the complexity of manufacture and risking quality deviation. Further, the sliding interface between conductive terminal and endbell during assembly is not designed to produce a sealed envelope between fuse contents and the environment.

The endbells are secured to the fuse body using insertion pins. Drilling holes in the endbells, which are typically made of a softer metal than the metal used for the fuse terminal, can be messy, resulting in contaminants being left inside the fuse body. Tight sealing of the endbells to the fuse body ensures that the fuse assembly operates as designed. Thus, the endbells may be sealed to the fuse body using adhesive materials, which can also be messy.

It is with respect to these and other considerations that the present improvements may be useful.

SUMMARY

This Summary is provided to introduce a selection of concepts in a simplified form that are further described below in the Detailed Description. This Summary is not intended to identify key or essential features of the claimed subject matter, nor is it intended as an aid in determining the scope of the claimed subject matter.

An exemplary embodiment of a fuse assembly in accordance with the present disclosure may include a fuse body to house a fuse element, a terminal assembly, and an endbell. The terminal assembly has first and second opposing surfaces and features a fuse element extending between a first terminal and a second terminal. The endbell includes first and second endbell portions, each having a crush rib. When the two endbell portions are fastened to one another with the terminal assembly sandwiched between them, the first crush rib engages the first surface of the terminal assembly and the second crush rib engages the second surface of the terminal assembly such that the first crush rib and the second crush rib form a seal around the terminal assembly.

An exemplary embodiment of an endbell in accordance with the present disclosure, along with a second endbell, is adapted to secure a terminal assembly inside a fuse housing and may include a first endbell portion and a second endbell portion. The first endbell portion has a first protrusion, a first receptacle, and a first crush rib. The first crush rib is adapted to engage with a first surface of a terminal assembly, which includes the fuse element. The second endbell portion has a second protrusion, a second receptacle, and a second crush rib. The second crush is adapted to engage with a second surface of the terminal assembly opposite a first surface. In response to the first endbell portion being fastened to the second endbell portion, the first protrusion engages the second receptacle and the second protrusion engages the first receptacle, forming a seal around the terminal assembly.

Another exemplary embodiment of a fuse assembly in accordance with the present disclosure may include a fuse body, first and second endbell portions, and first and second insertion pins. The fuse body is molded with first and second holes. The first endbell portion is molded with a first slot formed radially into its circumferential edge, forming a radial cavity through the first endbell. The second endbell portion is molded with a second slot formed radially into its circumferential edge, forming a radial cavity through the second endbell. The first insertion pin extends through the first hole and the first slot and the second insertion pin extends through the second hole and the second slot, and the first and second insertion pins secure the first and second endbell portions to the fuse body.

DETAILED DESCRIPTION

Novel fuse assembly designs are disclosed herein. Two-piece endbell designs enable the terminals and fuse element of the fuse assembly to be formed as a single piece, eliminating the manufacturing variability caused by having to separately attach the fuse element between the two terminals. The two-piece endbells as well as the terminal assembly feature elements that enable engagement of the endbell portions to the terminal assembly without use of adhesives. The elements also provide positioning guidance for ease of assembly. The endbell portions feature slots rather than cylindrical holes for receipt of insertion pins used to secure the endbells to the fuse body, thus avoiding costly rework of molding tools.

For the sake of convenience and clarity, terms such as "top", "bottom", "upper", "lower", "vertical", "horizontal", "lateral", "transverse", "radial", "inner", "outer", "left", and "right" may be used herein to describe the relative placement and orientation of the features and components of the fuse assemblies, each with respect to the geometry and orientation of the assemblies as they appear in the perspective, exploded perspective, and cross-sectional views provided herein. Said terminology is not intended to be limiting and includes the words specifically mentioned, derivatives therein, and words of similar import.

Fuse Assembly 100

Figure 1:
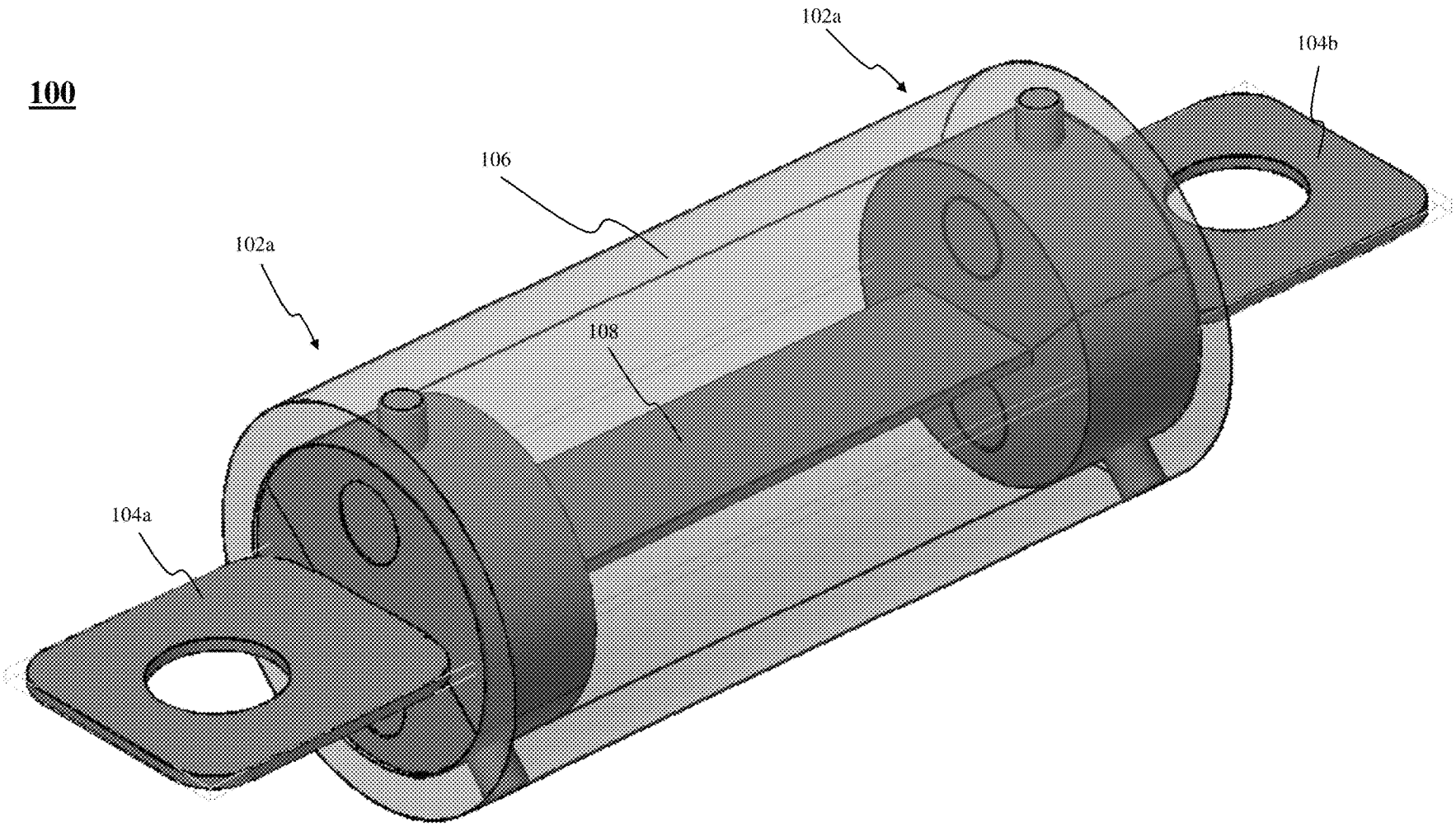
FIG. 1 is a diagram illustrating a fuse assembly, in accordance with exemplary embodiments.

FIG. 1 is a representative perspective view of a novel fuse assembly 100, according to exemplary embodiments. The fuse assembly 100 features a fuse body 106, which is transparent for ease of viewing other elements of the fuse assembly. Disposed at either end of the fuse body 106 are two endbells, a first endbell 102*a* and a second endbell 102*b* (collectively, "endbells 102"). A fuse element 108 is disposed between a first terminal 104*a* and a second terminal 104*b* (collectively, "terminals 104"). The fuse element 108 may assume shapes and configurations other than is shown in FIG. 1. As will be shown herein, the components of the fuse assembly 100 include features that facilitate secure affixation of the components as well as positioning guidance of the components during assembly, thus ensuring ease of manufacture.

Figure 2A:
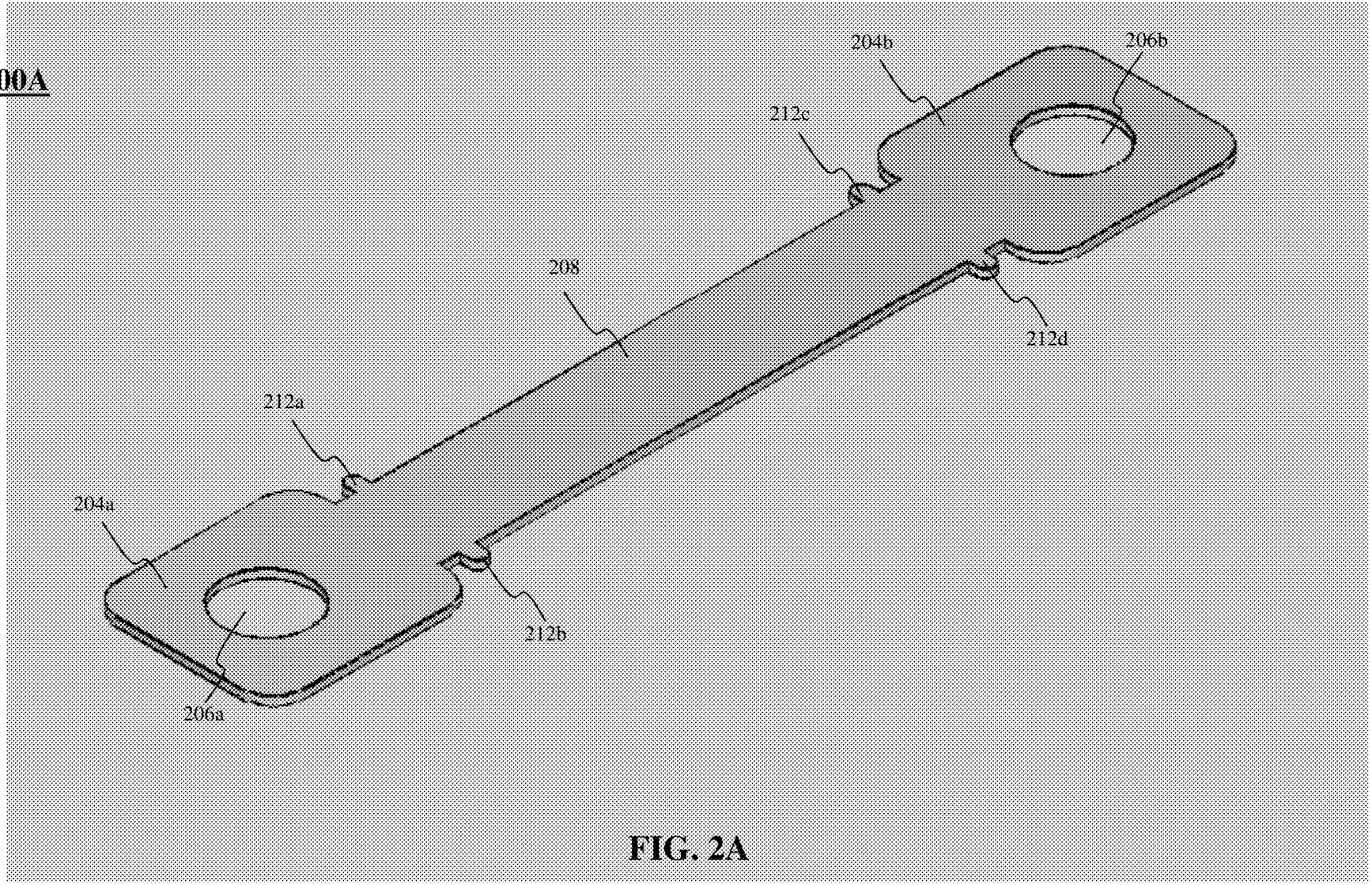
FIGS. 2A-2C are diagrams illustrating a terminal assembly for the fuse assembly of FIG. 1, in accordance with exemplary embodiments.
Figure 2B:
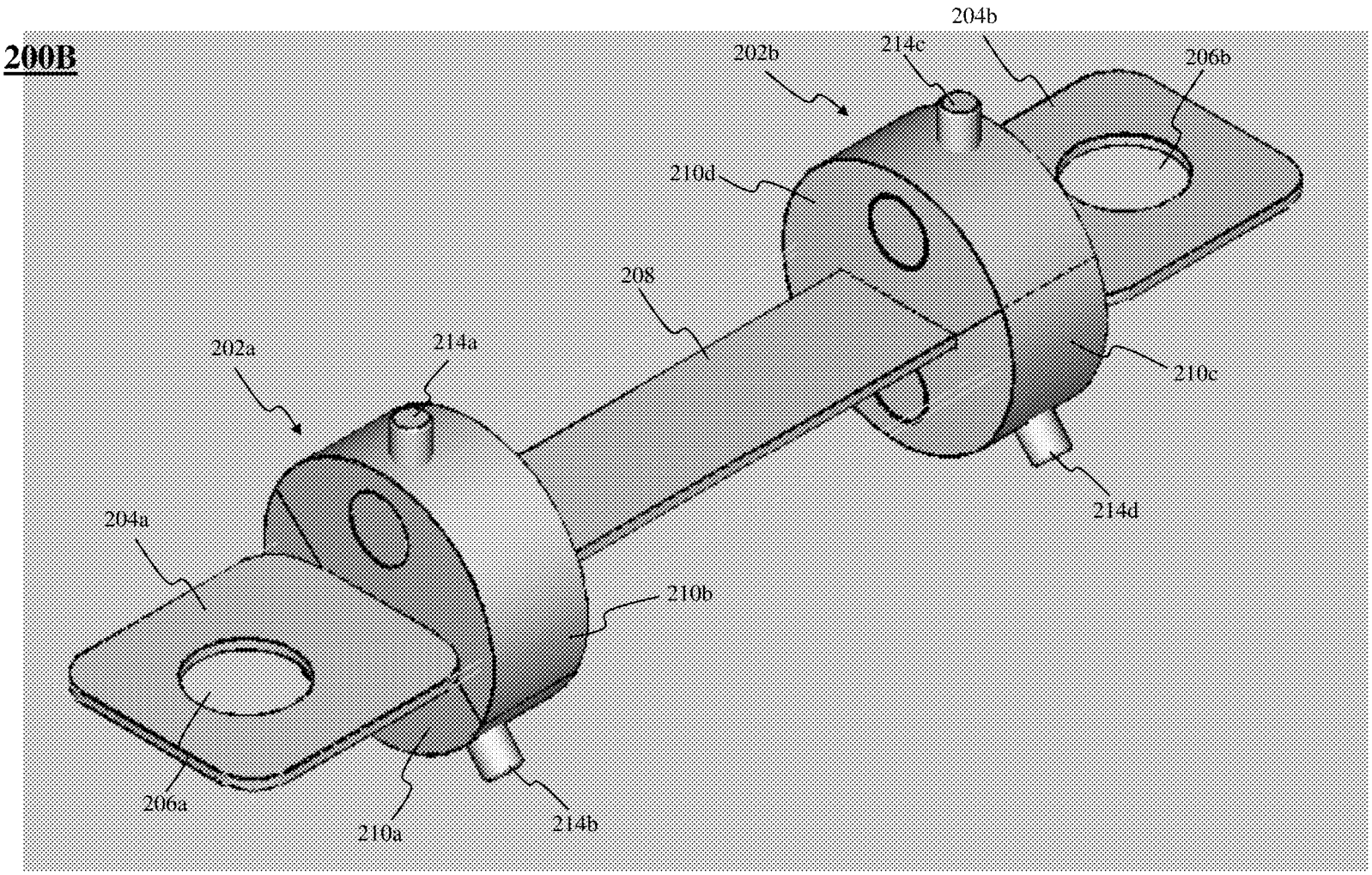
Figure 2C:
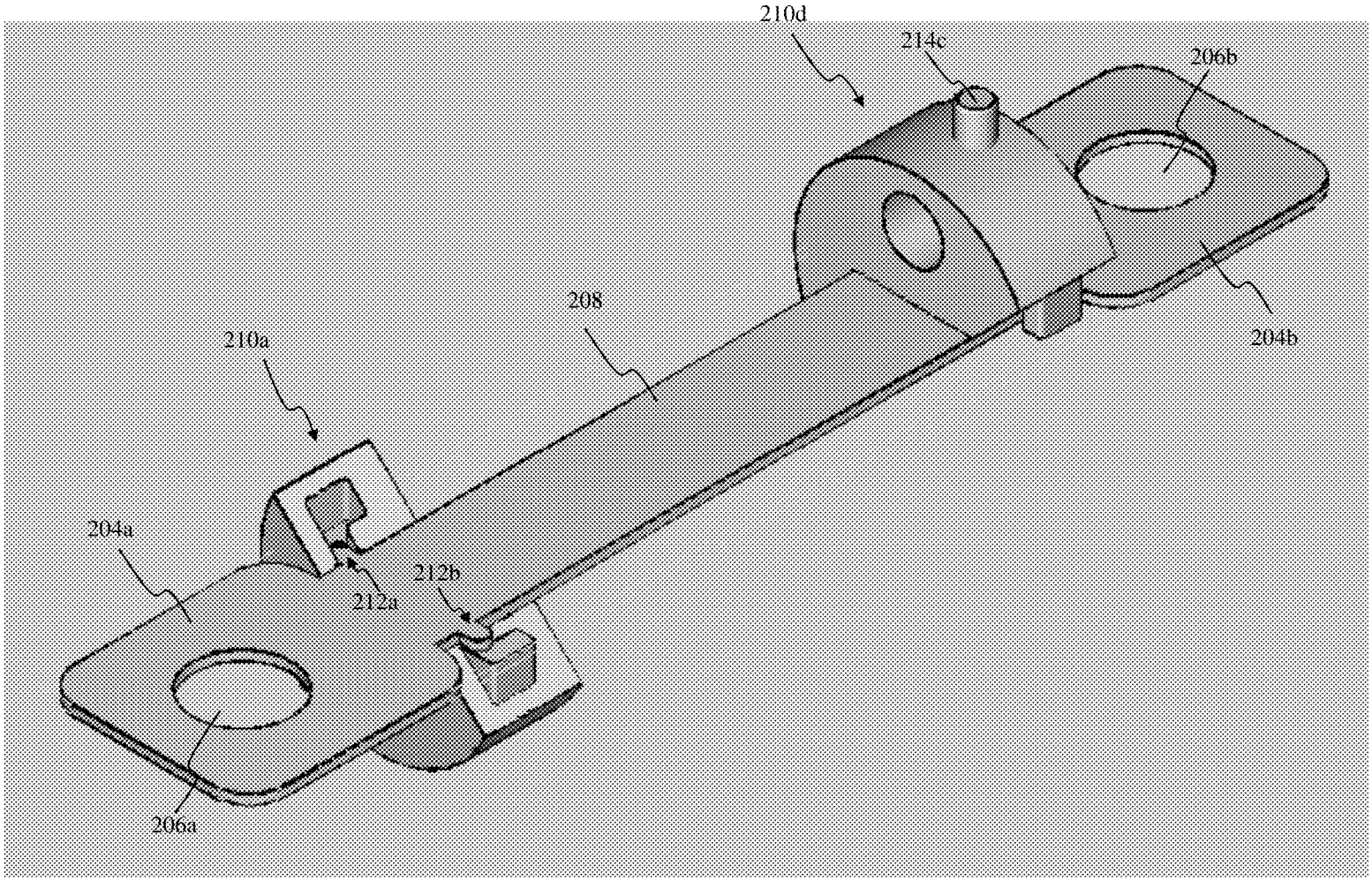

FIGS. 2A-2C are representative perspective views of a terminal assembly along with endbells and endbell portions, which are part of the fuse assembly 100 of FIG. 1, according to exemplary embodiments. FIG. 2A features a terminal assembly 200A consisting of a fuse element disposed between two fuse terminals; FIG. 2B features the fuse assembly 200B having two attached endbells; and FIG. 2C features the fuse assembly 200C with an attached bottom first endbell portion and top second endbell portion (collectively, "terminal assembly 200").

The terminal assembly 200A (FIG. 2A) consists of a fuse element 208 disposed between a first terminal 204*a* and a second terminal 204*b* (collectively, "terminals 204"). Known as the sacrificial portion of the fuse assembly 100 because it breaks in response to a fault condition, the fuse element 208 is shown as a simple, rectangular element having no bends or curves. In various alternative embodiments, the fuse element 208 may assume a variety of other shapes and sizes, may have twists or turns, may be thinner than or the same thickness as the terminals 204, and may consist of multiple pieces which are not shown in the figures. The present disclosure is not limited in this regard The fuse terminal 204 optionally includes terminal apertures 206*a* and 206*b* (collectively, "terminal apertures 206") for fixably attaching the fuse to an electrical circuit. Though they are shown as circular openings, the terminal apertures 206 may be any of a variety of shapes and sizes. As one example, the fuse terminal 204 may be attached to a busbar by inserting electrically conductive bolts through the terminal apertures 206, thus forming an electrical connection between the fuse and the busbar.

In an exemplary embodiment, the terminals 204 and the fuse element are formed as a unitary metallic, conductive material, such as zinc, copper, silver, aluminum, or alloys or combinations thereof, though the terminal assembly 200 shown and described herein is not limited to such a configuration. In other embodiments, the terminal assembly 200 of the fuse assembly 100 is formed by connecting the terminals 204 to either side of the fuse element 208, such as by soldering, welding, or other means.

In an exemplary embodiment, the terminal assembly 200 features protruding lips formed proximate to each terminal. A first lip 212*a* and a second lip 212*b* are located on opposing sides of the terminal assembly 200 close to the first terminal 204*a*; similarly, a third lip 212*c* and a fourth lip 212*d* are located on opposing sides of the terminal assembly 200, close to the second terminal 204*b* (collectively, "lips 212"). As illustrated in FIG. 2C, the lips 212 are mating features which facilitate connection of the endbells to the terminal assembly 200, in exemplary embodiments. The lips 212 are described in more detail in conjunction with the description of FIGS. 4A and 4B, below.

Endbells 202*a* and 202*b* are shown in FIG. 2B (collectively, "endbells 202"). In exemplary embodiments, each endbell 202 consists of two parts or halves. The first endbell 202*a* consists of a first endbell portion 210*a* (bottom) and a second endbell portion 210*b* (top); the second endbell 202*b* consists of a first endbell portion 210*c* (bottom) and a second endbell portion 210*d* (top) (collectively, "endbell portions 210"). The endbell portions 210 are designed to be engaged with, such as by press-fitting, into the terminal assembly 200 at the location of the lips 212. In an exemplary embodiment, the endbell portions 210 are manufactured using a zinc alloy.

In legacy fuse designs, the endbells are a single-piece design having a rectangular slot in each endbell. The fuse element is slid through the slots of each endbell, followed by the attachment of the terminals to each end of the fuse element, such as by soldering, welding, and the like. In exemplary embodiments, the two-piece endbell design of the fuse assembly 100 enables the terminals and fuse element to be formed as a single piece, eliminating the manufacturing variability caused by having to separately attach the fuse element between the two terminals.

FIG. 2C shows the endbell portion 210*a* of the first endbell 202*a* and the endbell portion 210*d* of the second endbell 202*b*. In an exemplary embodiment, the endbell portions 210*a*, 210*b*, 210*c*, and 210*d* are substantially similar and interchangeable with one another. The endbell portions 210 are disposed next to the terminal 204 at the location of the lips 212. Described in more detail in conjunction with the descriptions of FIGS. 3A-3B and 4A-4B, below, the endbell portions 210 include features that enable first and second endbell portions (e.g., 210*a* and 210*b* of endbell 202*a* or 210*c* and 210*d* of endbell 202*b*) to mate with one another. Further, the lips 212 facilitate both placement of the endbell portions 210 and coupling of the endbell portions to the terminal assembly 200 of the fuse assembly 100.

In exemplary embodiments, the endbells 202 further include insertion pins (FIGS. 2B and 2C). The first endbell 202*a* includes insertion pins 214*a* and 214*b*; the second endbell 202*b* includes insertion pins 214*c* and 214*d* (collectively, "insertion pins 214"). In one embodiment, the insertion pins 214 are made of a metal or metal alloy, such as stainless steel. The number of insertion pins may vary. In one embodiment, each endbell portion 210 includes one insertion pin 214. In an exemplary embodiment, the insertion pins 214 enable connection between the endbells 202 and the fuse body 106 (see also FIG. 1). The insertion pins 214 are described in more detail in in conjunction with the description of FIG. 12, below.

Figure 3B:
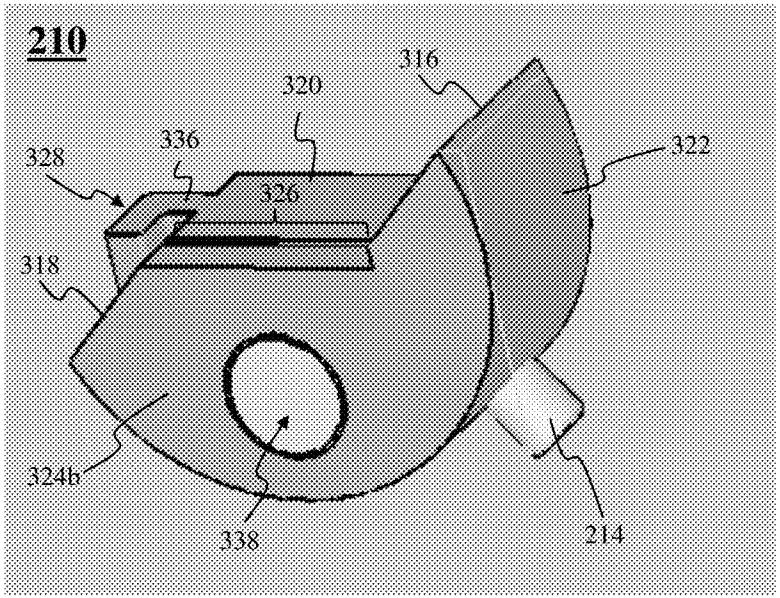
FIGS. 3A and 3B are diagrams illustrating endbell portions for the fuse assembly of FIG. 1, in accordance with exemplary embodiments.
Figure 3A:
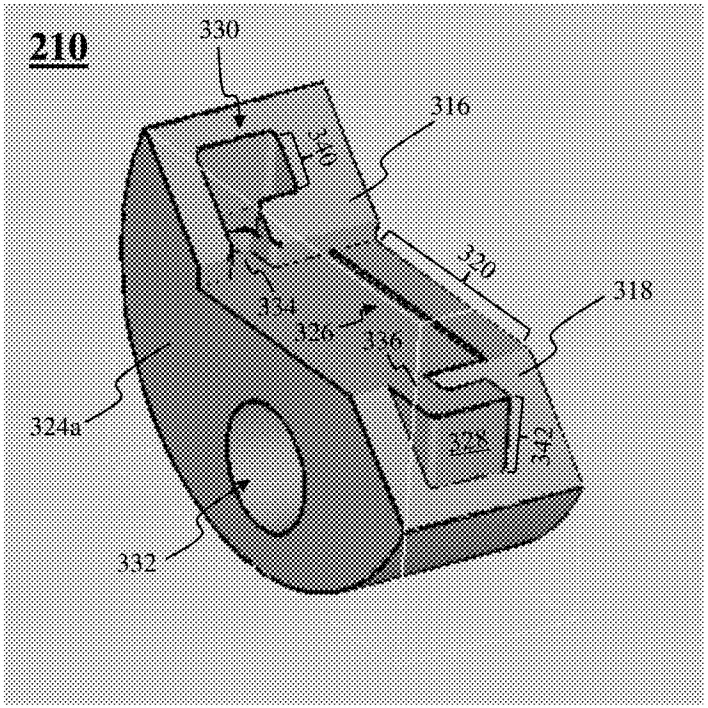

FIGS. 3A and 3B are representative drawings of the endbell portions 210, according to exemplary embodiments. The perspective views of the endbell portions 210 are given from different angles, making visible some additional details. Because each endbell portion 210 is substantially similar to each other endbell, whether disposed on top, on bottom, on the left side, or on the right side, of the terminal assembly 200, the various features of the endbell portions are also substantially similar, in some embodiments.

Each endbell portion 210 includes a first diagonal surface 316, a second diagonal surface 318, a center (horizontal) surface 320, a semi-circular surface 322, and two flat side surfaces 324*a* and 324*b* (collectively, "side surfaces 324"). With the exception of the semi-circular surface 322, the other surfaces are substantially flat. The center surface 320 is formed on either side of the first and second diagonal surfaces 316, 318.

Each surface of the endbell portion 210 includes a feature. The side surfaces 324 show an endbell aperture 332, which is a transverse cylindrical void visible on either side of the endbell portion 210. The endbell aperture 332 is used to fill the fuse assembly 100 with sand or other material once the two endbells are connected to the fuse body, after which the aperture is sealed with plugs 338 on both sides (FIG. 3B). The semi-circular surface 322 shows an insertion pin 214 extending radially from its surface.

Further, in exemplary embodiments, the first diagonal surface 316 features a receptacle 330 and the second diagonal surface 318 features a protrusion 328. The receptacle 330 of one endbell portion 210 is designed to mate with the protrusion 328 of a second endbell portion. In exemplary embodiments, when the mating occurs, the diagonal surface 316 of one endbell portion 210 will be flush against the diagonal surface 318 of the other endbell portion.

The receptacle 330 includes a flat surface, known herein as a lip seat 334, that extends from the center portion 320, and a block receiver 340 orthogonal to the lip seat. Likewise, the protrusion 328 has a flat surface, a lip seat 336, that extends from the center portion, and a block 342 orthogonal to the lip seat. In exemplary embodiments, two lips of the terminal assembly 200 mate with the endbell portion 210 so that one lip is disposed on the lip seat 334 of the receptacle 330, while the second lip is disposed on the lip seat 336 of the protrusion 328 (see FIG. 2C). This enables the terminal assembly 200 to be seated between two engaged endbell portions 210 that form the endbell 202, such that a seal is formed between the endbell portions and the terminal assembly. Further, the block 342 of one endbell portion 210 engages the block receiver 340 of the other endbell portion. Designers of ordinary skill in the art will recognize that the lip seat 334 and block receiver 340 of receptacle 330 and the lip seat 336 and block 342 of protrusion 328 may vary in shape and size, while still providing the desired mating properties to the endbell portions 210. Further, where the receptacle 330 and protrusion 320 are modified, the lips 212 of the terminal assembly 200 may be varied as well to facilitate mating of the components.

In exemplary embodiments, the center surface 320 features a crush rib 326 extending between (intermediate) the first diagonal surface 316 and the second diagonal surface 318. In one embodiment, the crush rib 326 is disposed, not in the center of the center surface 320, but to one side, closer to the side surface 324*b* than to the side surface 324*a*. The crush rib 326 is also placed so as to avoid the lip seats 334, 336, though the placement of the crush rib 326 may vary from what is illustrated. In an exemplary embodiment, when two endbell portions 210 are engaged with each other, the crush rib 326 of the upper endbell portion (e.g., endbell portion 210*b*, FIG. 2B) is disposed directly over the crush rib of the lower endbell portion (e.g., endbell portion 210*a*), with the terminal assembly 200 disposed between the two endbell portions. In exemplary embodiments, the crush ribs 326, along with the lips 212, facilitate placement of the terminal assembly 200 between the two endbell portions 210. In one embodiment, the terminal assembly 200 includes depressions or other receiving structures for mating with the crush ribs 326.

Figure 4B:
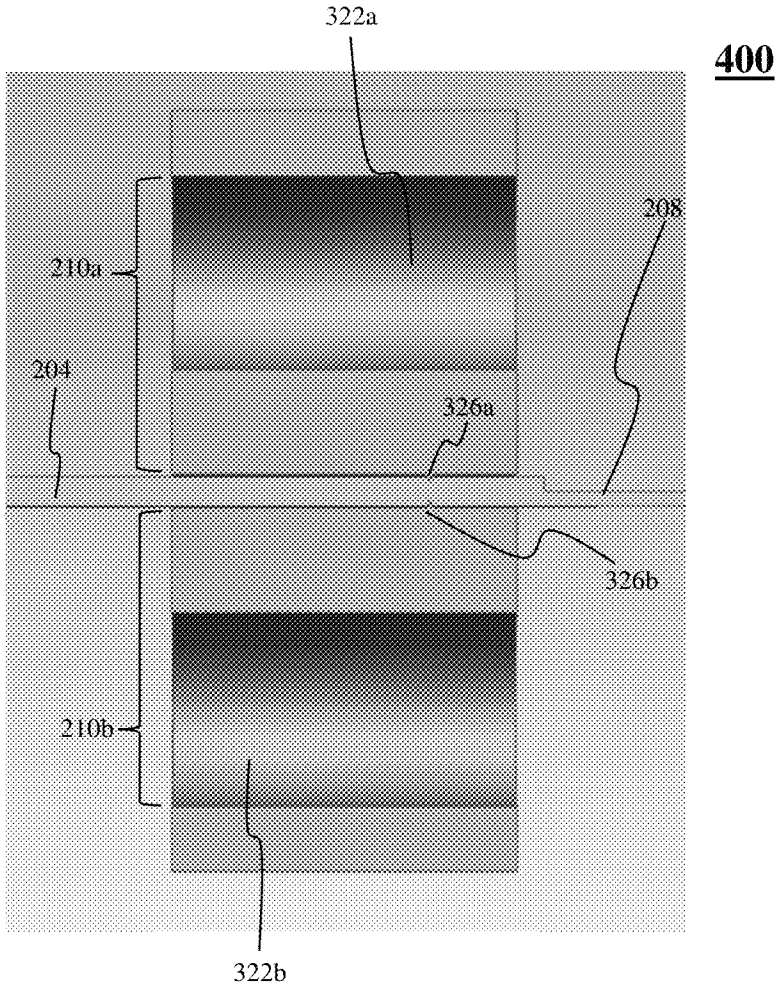
FIGS. 4A and 4B are diagrams illustrating endbell portion coupling for the fuse assembly of FIG. 1, in accordance with exemplary embodiments.
Figure 4A:
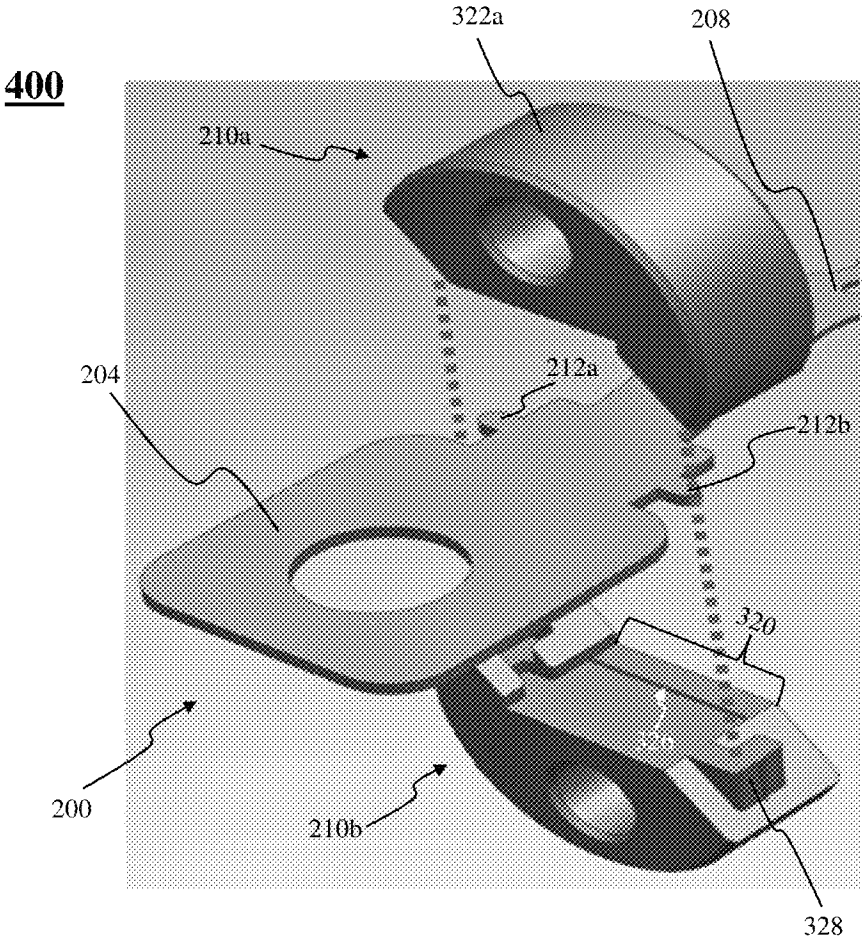

FIGS. 4A and 4B are representative drawings of endbell portion coupling 400 for the fuse assembly 100 of FIG. 1, according to exemplary embodiments. FIG. 4A is an exploded perspective view and FIG. 4B is a cross-sectional view of the endbell portion coupling 400. The first endbell portion 210*a* and the second endbell portion 210*b* are disposed on either side of the fuse terminal 204. Once the two endbell portions 210 are engaged with each other, such as by press-fitting together, with the lips 212 of the terminal assembly 200 disposed therebetween, the endbell portions are radially secured to one another, and a seal is formed between the endbell portions and the terminal assembly.

In exemplary embodiments, when the two endbell portions 210 are engaged with and radially secured to one another, the crush ribs 326 mate with the terminal assembly 200 and deform. A first crush rib 326*a* for endbell portion 210*a* and a second crush rib 326*b* for endbell portion 210*b* is shown. The terminal assembly 200, which may be made from copper or copper alloy, is pressed firmly against the zinc or zinc alloy material of the endbell portions 210, such that some compression and possibly deformation of the two materials occurs. In an exemplary embodiment, the pressure of connecting the crush ribs 326 against the terminal assembly 200 produces a sealed envelope between the contents of the fuse assembly 100 and the external environment.

Although a single crush rib 326 (per endbell portion 210) is shown, there may be multiple crush ribs 326 on each endbell portion. Further, these features may be presented in different locations on the respective endbell portions 210 without limitation.

In an exemplary embodiment, the endbell portions 210 are pressed around the terminal assembly 200 during manufacture, resulting in a concentric circular endbell on each end of the fuse (FIGS. 1 and 2B). The features of each endbell portion 210 (the protrusions 328, the receptacles 330, and the crush ribs 326) can be used to both locate to mating features (the lips 212) on the terminal assembly 200 as well as align the two endbell portions.

In exemplary embodiments, once mated, the two endbell portions 210 become fixably attached without using an adhesive or sealant. This eliminates the need for endbell/ terminal surface regularity. The crush ribs 326 in the endbell portions 210 bite into the terminal assembly 200, deforming material in both the endbell portions and the terminal assembly. Thus, if the surface of either the endbell portion 210 or the terminal assembly 200 is not perfectly flat, the deformed-fit interface can still make a firm seal between the two materials. In an exemplary embodiment, the intentional interference of the crush ribs 326 with terminal assembly 200 provides mechanical support and a fixed connection between endbell portions 210 and the terminal assembly 200. Further, in an exemplary embodiment, the pressure of connecting the crush ribs 326 with the terminal assembly 200 produces a sealed envelope between the fuse contents and the external environment. The mating elements of the novel fuse assembly 100 thus provide both secure affixation of the endbells to the fuse body and provide positioning guidance during assembly for ease of manufacturing the fuse assembly.

Fuse Assembly 500

Figure 5:
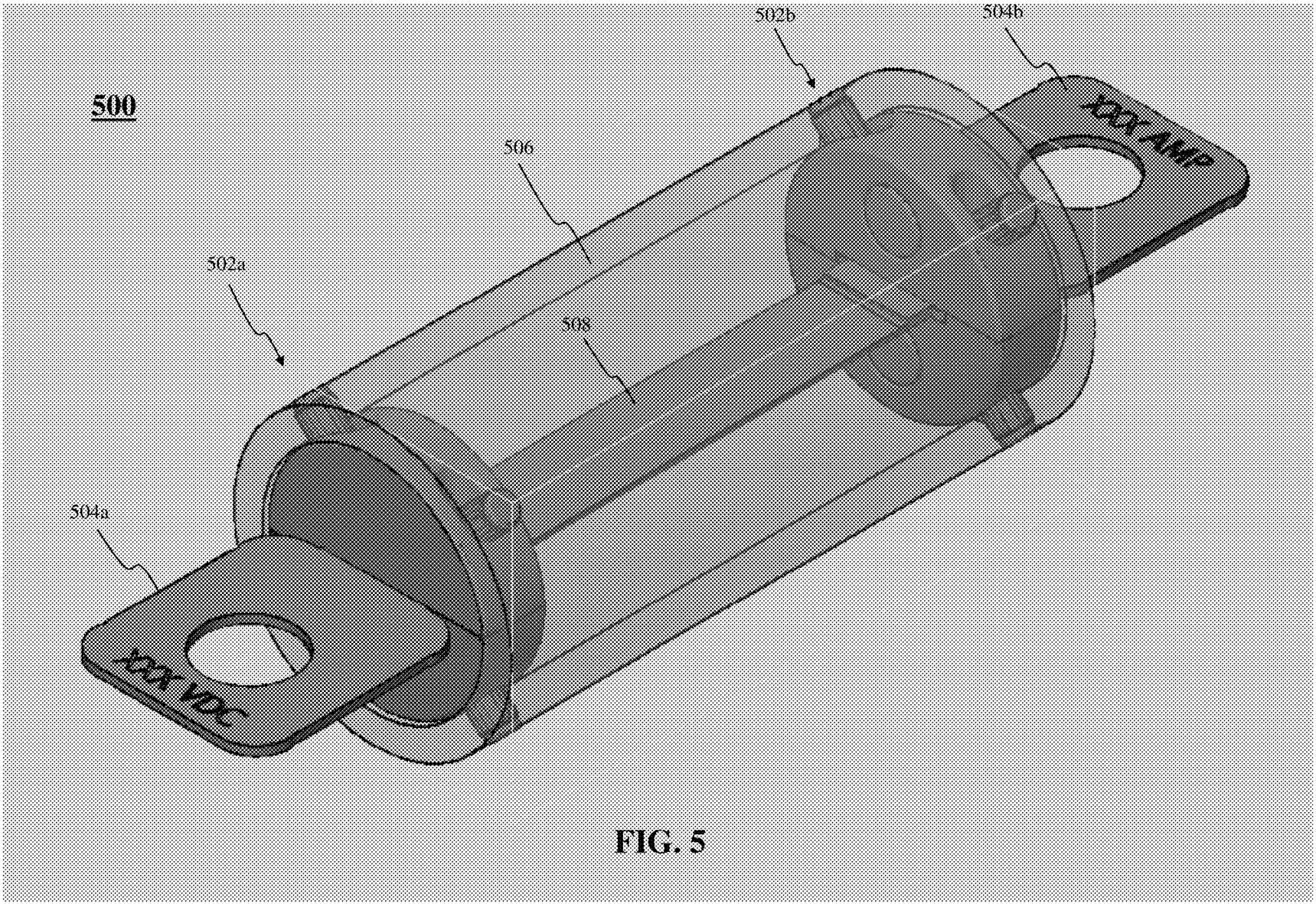
FIG. 5 is a diagram illustrating a fuse assembly, in accordance with exemplary embodiments.

FIG. 5 is a representative perspective view of a novel fuse assembly 500, according to exemplary embodiments. The fuse assembly 500 features a fuse body 506, which is transparent for ease of viewing other elements of the fuse assembly. Disposed at either end of the fuse body 506 are two endbells, a first endbell 502*a* and a second endbell 502*b* (collectively, "endbells 502"). A fuse element 508 is disposed between a first terminal 504*a* and a second terminal 504*b* (collectively, "terminals 504"). The fuse element 508 may assume shapes and configurations other than is shown in FIG. 5. As will be shown herein, both the endbells 502 and terminal assembly of the fuse assembly 500 include mating elements that provide secure affixation between the endbells and the fuse body, as well as providing positioning guidance for component assembly, thus facilitating ease of manufacture.

Figure 6A:
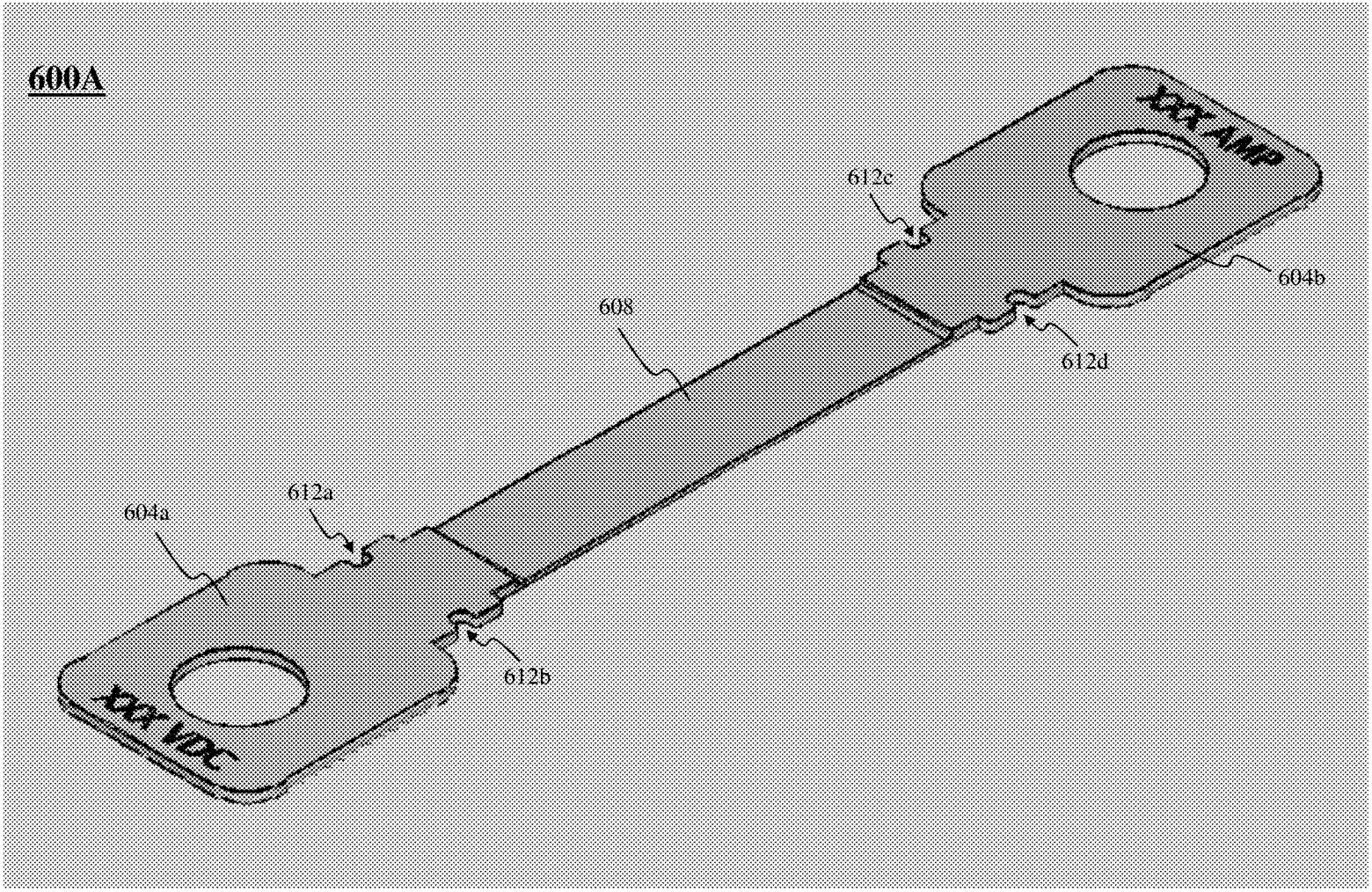
FIGS. 6A-6C are diagrams illustrating a terminal assembly for the fuse assembly of FIG. 5, in accordance with exemplary embodiments.
Figure 6B:
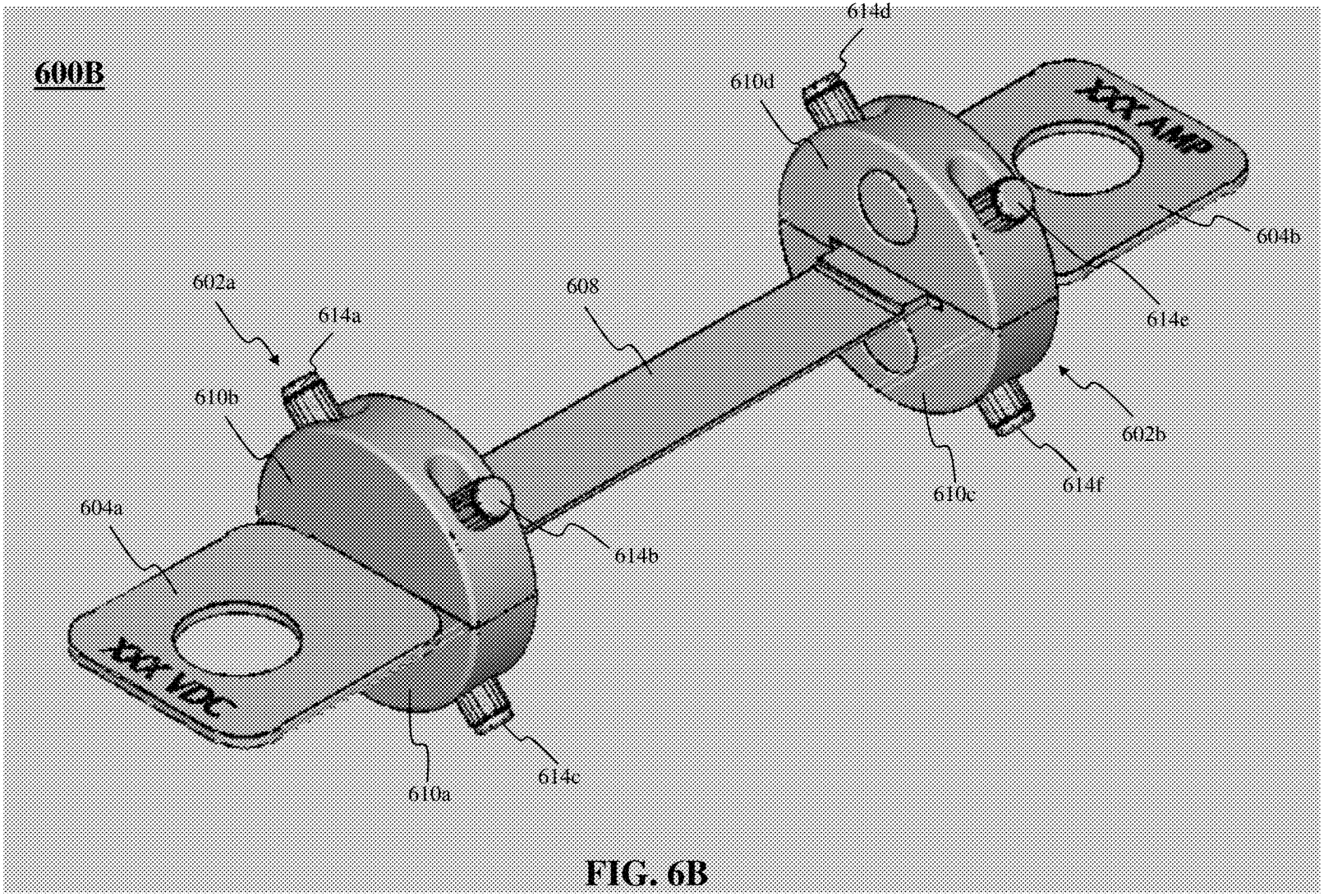
Figure 6C:
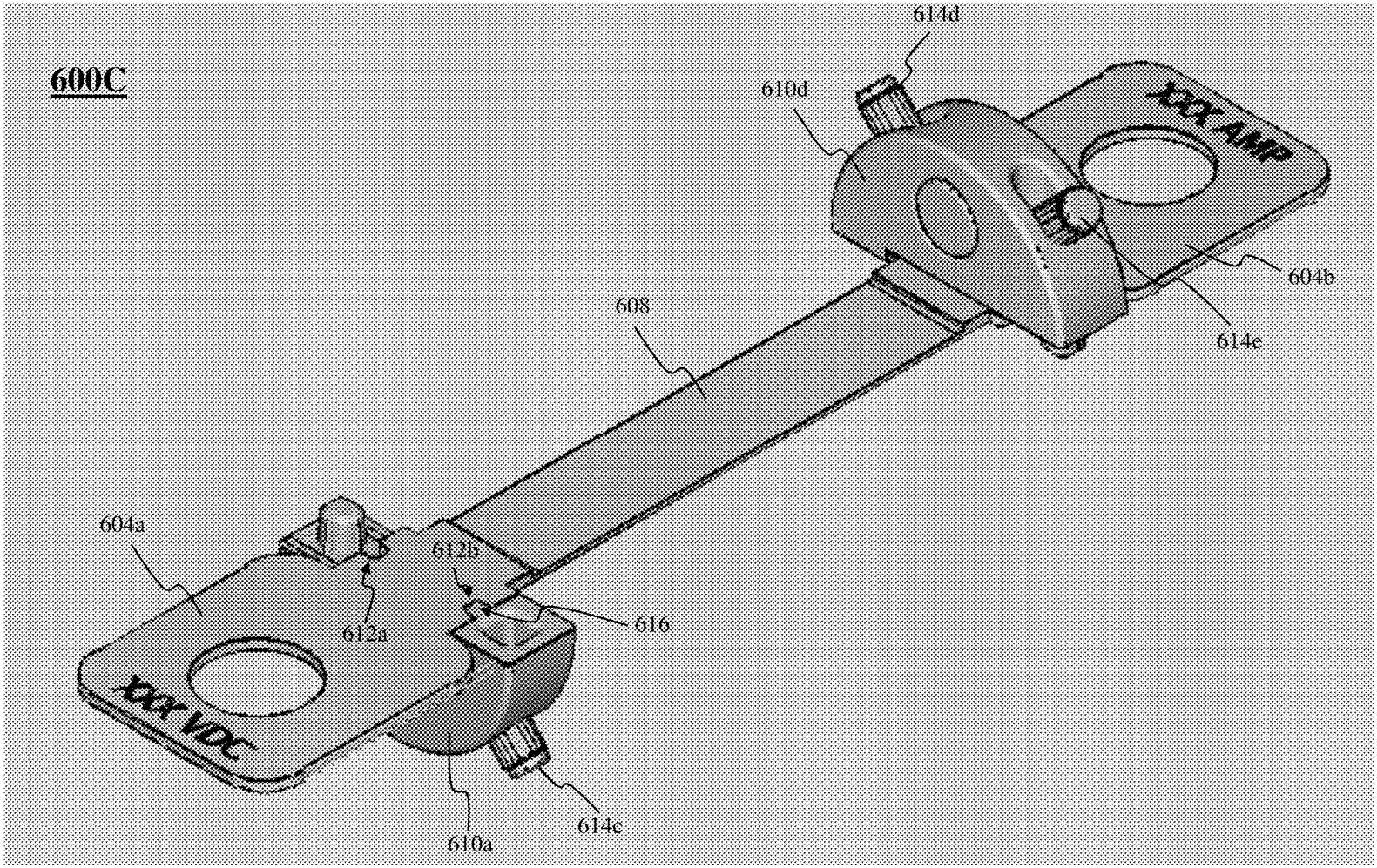

FIGS. 6A-6C are representative perspective views of a terminal assembly along with endbells and endbell portions, which are part of the fuse assembly 500 of FIG. 5, according to exemplary embodiments. FIG. 6A features a terminal assembly 600A consisting of a fuse element disposed between two fuse terminals; FIG. 6B features the terminal assembly 600B having two attached endbells; and FIG. 6C features the terminal assembly 600C with an attached bottom first endbell portion and top second endbell portion (collectively, "terminal assembly 600").

The terminal assembly 600A (FIG. 6A) consists of a fuse element 608 disposed between a first terminal 604*a* and a second terminal 604*b* (collectively, "terminals 604"). The fuse element 608 is shown as a simple, rectangular element having no bends or curves but may assume a variety of shapes and sizes, as the particular shape or size of the fuse element 608 is not meant to be limiting. In an exemplary embodiment, the terminals 604 and the fuse element are formed as a unitary metallic, conductive material, such as zinc, copper, silver, aluminum, or alloys or combinations thereof. The present disclosure is not limited in this regard.

In an exemplary embodiment, the terminal assembly 600 features recesses disposed proximate to each terminal. A recess 612*a* and a recess 612*b* are located on opposing sides of the terminal assembly 600 close to the first terminal 604*a*; similarly, a recess 612*c* and a recess 612*d* are located on opposing sides of the terminal assembly 600, close to the second terminal 604*b* (collectively, "recesses 612"). As illustrated in FIG. 6C, the endbell portion 610*a* includes a projection 616 that mates with the recess 612*b*. The recesses 612 and projections 616 facilitate connection of the endbells to the terminal assembly 600, in exemplary embodiments. The projections 616 are described in more detail in conjunction with the description of FIG. 7A, below.

Endbells 602*a* and 602*b* are shown in FIG. 6B (collectively, "endbells 602"). In exemplary embodiments, each endbell 602 consists of two parts or halves. The first endbell 602*a* consists of a first endbell portion 610*a* and a second endbell portion 610*b*; the second endbell 602*b* consists of a first endbell portion 610*c* and a second endbell portion 610*d* (collectively, "endbell portions 610"). The endbell portions 610 are designed to be engaged with respective surfaces of the terminal assembly 600 at the location of the lips 612 and the projections 616. In an exemplary embodiment, the endbell portions 610 are formed of a zinc alloy.

FIG. 6C shows the first endbell portion 610*a* of the first endbell 602*a* and the second endbell portion 610*d* of the second endbell 602*b*. In an exemplary embodiment, the endbell portions 610*a*, 610*b*, 610*c*, and 610*d* are substantially similar and interchangeable with one another. The endbell portions 610 are disposed next to the terminal 604 at the location of the recesses 612. Described in more detail in conjunction with the descriptions of FIGS. 7A-7B and FIGS. 8A-8B, below, the endbell portions 610 include features that enable first and second endbell portions (e.g., 610*a* and 610*b* of endbell 602*a* or 610*c* and 610*d* of endbell 602*b*) to mate with one another. Further, the recesses 612 facilitate both placement of the endbell portions 610 and coupling of the endbell portions to the terminal assembly 600 of the fuse assembly 500.

Although FIGS. 6B and 6C show endbell portions 610, in an alternative embodiment, the terminal assembly 600 and the fuse assembly 500 may alternatively be fitted with endbell portions 810, as illustrated and described in FIGS. 8A and 8B, below.

In exemplary embodiments, the endbells 602 further include insertion pins (FIGS. 6B and 6C). The first endbell 602*a* includes insertion pins 614*a*, 614*b*, and 614*c*; the second endbell 602*b* includes insertion pins 614*d*, 614*e*, and 614*f* (collectively, "insertion pins 614"). In exemplary embodiments, each endbell 602 further includes a fourth insertion pin (not shown). In one embodiment, the insertion pins 614 are made of a metal or metal alloy, such as zinc alloy. The number of insertion pins may vary. In one embodiment, each endbell portion 610 includes two insertion pins 614. In an exemplary embodiment, the insertion pins 614 enable connection between the endbells 602 and the fuse body 106 (see also FIG. 5). The insertion pins 614 are described in more detail in in conjunction with the description of FIG. 12, below.

Figures 7A, 7B:
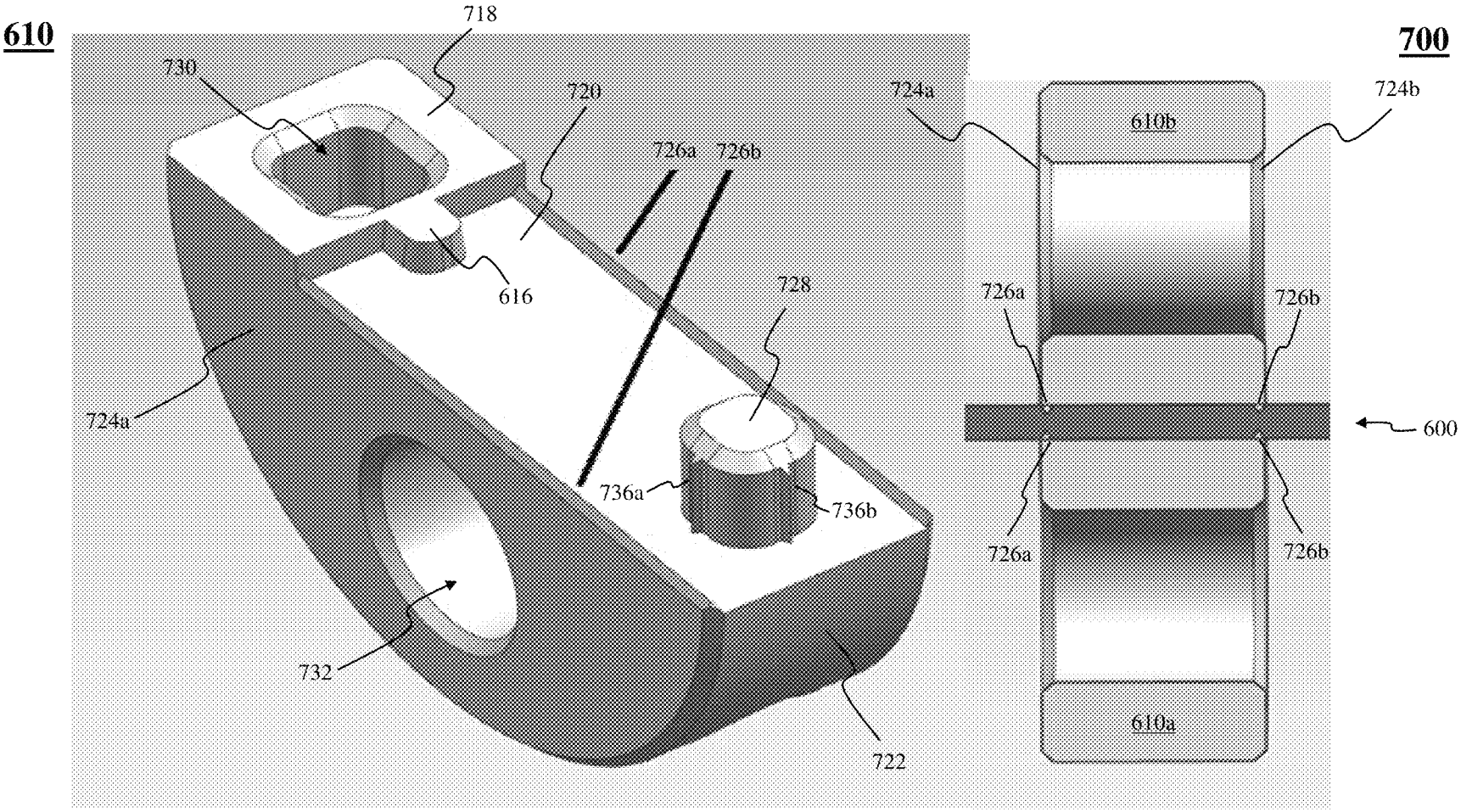
FIGS. 7A and 7B are diagrams illustrating endbell portion and endbell portion coupling of the fuse assembly of FIG. 5, in accordance with exemplary embodiments.

FIGS. 7A and 7B are representative drawings of endbell portion 610 and endbell portion coupling 700, respectively, according to exemplary embodiments. FIG. 7A shows an endbell portion 610; FIG. 7B shows a cross-sectional view of the endbell portion coupling 400 for the fuse assembly 500 of FIG. 5. Because each endbell portion 610 is substantially similar to each other endbell portion, whether disposed on top, on bottom, on the left side, or on the right side, of the terminal assembly 600, the various features of the endbell portions are also substantially similar.

Each endbell portion 610 includes a feature surface 720, including a raised portion 718, a semi-circular surface 722 at a circumferential edge of the endbell portion, and two flat side surfaces 724*a* and 724*b* (collectively, "side surfaces 724"). Side surface 724*a* shows an endbell aperture 732, which is a transverse cylindrical void visible on either side of the endbell portion 610. The endbell aperture 732 is used to fill the fuse assembly 500 with sand or other material once the two endbells are connected to the fuse body, after which the aperture is sealed with plugs on both sides (FIGS. 5 and 6B).

In exemplary embodiments, the feature surface 720 includes a protrusion 728 while the raised portion 718 of the feature surface 720 includes a receptacle 730. The receptacle 730 of one endbell portion 610 is designed to receive the protrusion 728 of a second endbell portion, thereby mating the two endbell portions. In exemplary embodiments, when the mating occurs, the raised portion 718 is raised up, relative to the feature surface 720, thus allowing room for the terminal assembly 600 to be disposed between the two endbell portions 610.

First introduced in FIG. 6C, the projection 616 of the raised portion 718 extends into the feature surface 720. In exemplary embodiments, the recesses 612 of the terminal assembly 600 mate with respective projections 616 of the endbell portion 610 so that the endbell portions can successfully mate with the terminal assembly 600. The recesses 612 and projections 616 thus provide a guide for positioning of the endbell portions 610 upon the upper and lower surfaces of the terminal assembly 600. Designers of ordinary skill in the art will recognize that the recesses 612 and projections 616 may vary in shape and size, while still providing the desired mating properties to the endbell portions 610.

In exemplary embodiments, the feature surface 720 further features two crush ribs 726*a* and 726*b* disposed at the edges of the feature surface (collectively, "crush ribs 726"). In an exemplary embodiment, when two endbell portions 610 are engaged with one another, the crush rib 726*a* of the first endbell portion (e.g., endbell portion 610*b*, FIG. 6B) is disposed directly over the crush rib of the second endbell portion (e.g., endbell portion 610*a*), with the terminal assembly 600 disposed between the two endbell portions, thus forming a seal between the endbell portions and the terminal assembly. Similarly, the crush rib 726*b* of the one endbell portion is disposed directly over a second crush rib of another endbell portion. In exemplary embodiments, the projection 616 facilitates placement of the each endbell portion 610 upon the terminal assembly 600.

In exemplary embodiments, the protrusion 728 of the endbell portion 610 further includes one or more ribs. Ribs 736*a* and 736*b* are visible in FIG. 7A (collectively, "ribs 736"), though there may be more or fewer ribs than are shown. The ribs 736 on the protrusion 728 are another engagement feature which deform in the receptacle 730 during assembly to retain the relative positions of the two endbell portions 610. Thus, when the endbells 610 are engaged with one another, the ribs 736, like the crush ribs 726, facilitate melding of the respective components together, resulting in an air-tight coupling and formation of a seal between the endbells 602 without use of adhesive. The recesses 612 and projections 616 similarly help seal the endbell portions 610 against the terminal assembly 600.

In exemplary embodiments, as illustrated in the cross-sectional view of FIG. 7B, when the two endbell portions 610 are engaged with and radially secured to one another, the crush ribs 726 mate with the terminal assembly 600 and deform. First and second crush ribs 726*a* and 726*b* for endbell portion 610*b* and third and fourth crush ribs 726*c* and 726*d* for endbell portion 610*a* are shown. The terminal assembly 600, which may be made from copper or copper alloy, is pressed firmly against the zinc or zinc alloy material of the endbell portions 610, such that some compression and/or deformation of the two materials occurs. The optional ribs 736 also facilitate the fixed coupling of the two endbell portions 610. In an exemplary embodiment, the pressure of connecting the crush ribs 726 with the terminal assembly 600 produces a sealed envelope between the contents of the fuse assembly 500 and the external environment.

In an exemplary embodiment, the endbell portions 610 are pressed around the terminal assembly 600 during manufacture, resulting in a concentric circular endbell on each end of the fuse (FIGS. 5 and 6B). The features of each endbell portion 610 (the protrusions 728 and the receptacles 730) can be used to align the two endbell portions while the projection 616 of each endbell portion is used to "locate" respective recesses 612 on the terminal assembly 600.

In exemplary embodiments, once mated, the two endbell portions 610 become fixably attached without using an adhesive or sealant. This eliminates the need for endbell/terminal surface regularity. The crush ribs 726 in the endbell portions 610 bite into the terminal assembly 600, deforming material in both the endbell portions and the terminal assembly. Thus, if the surface of either the endbell portion 610 or the terminal assembly 600 is not perfectly flat, the engagement interface can still make a firm seal between the two materials. In an exemplary embodiment, the intentional interference of the crush ribs 726 with the surfaces of the terminal assembly 600 provides mechanical support and a fixed connection between endbell portions 610 and the terminal assembly. Further, in an exemplary embodiment, the pressure of connecting the crush ribs 726 the terminal assembly surfaces produces a sealed envelope between the fuse contents and the external environment.

Figures 8A, 8B:
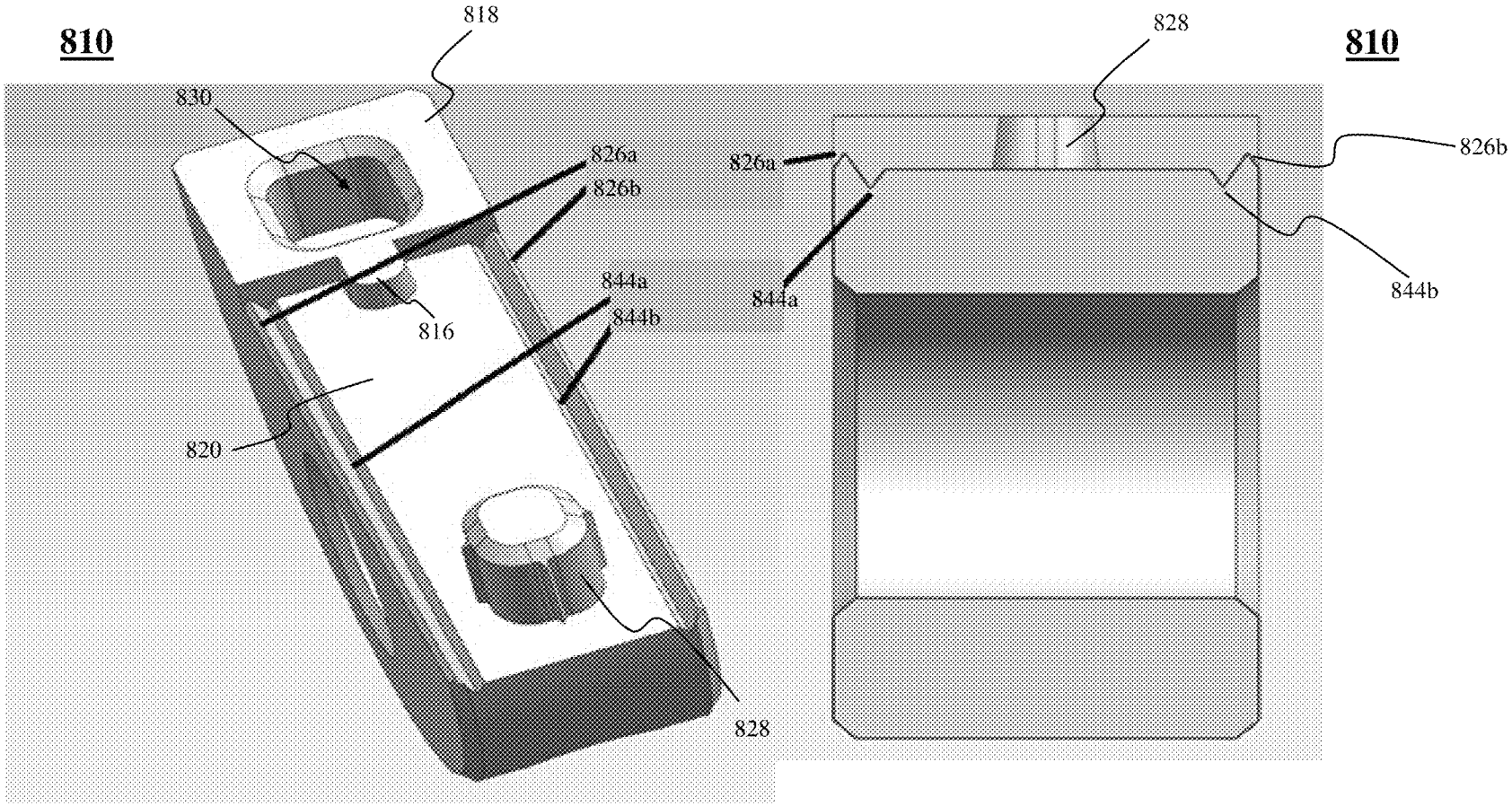
FIGS. 8A and 8B are diagrams illustrating endbell portions for the fuse assembly of FIG. 5, in accordance with exemplary embodiments.

FIGS. 8A and 8B are representative drawings of endbell portion 810, according to exemplary embodiments. FIG. 8A is a perspective view and FIG. 8B is a cross-sectional view of the endbell portion 810. The endbell portion 810 may be part of the fuse assembly 500 of FIG. 5. The endbell portion 810 features a feature surface 820 with a raised portion 818, where the feature surface 820 includes a protrusion 828 and the raised portion includes a receptacle 830. The protrusion 828 and receptacle 830 facilitate connection of the endbells 610 to the terminal assembly 600, in exemplary embodiments. The endbell portion 810 also features a projection 816. The projection 816 is designed to mate with the recess 612 of the terminal assembly 600 (FIG. 6C). The recesses 612 and projections 816 facilitate positioning guidance when connecting the endbell portions to the terminal assembly 600, in exemplary embodiments.

As with the endbell 610 (FIGS. 7A and 7B), the endbell 810 also features two crush ribs 826*a* and 826*b* disposed at the edges of the feature surface 820 (collectively, "crush ribs 826"). In an exemplary embodiment, when two endbell portions 810 are engaged with one another, such as by press-fitting, the crush rib 826*a* of the upper endbell portion is disposed directly over the crush rib of the lower endbell portion, with the terminal assembly 600 disposed between the two endbell portions. Similarly, the crush rib 826*b* of the upper endbell portion is disposed directly over a second crush rib of the lower endbell portion. In exemplary embodiments, the two crush ribs 826, along with the projection 816, facilitate placement of the each endbell portion 810 upon the terminal assembly 600.

Further, in exemplary embodiments, the endbell 810 features troughs which are adjacent to the crush ribs 826. Trough 844*a* is adjacent to crush rib 826*a* while trough 844*b* is adjacent to crush rib 826*b* (collectively, "troughs 844"). In the cross-sectional view of FIG. 8B, the crush ribs 826 are shown as projections while the troughs 844 are shown as depressions. When the endbell portions 810 are engaged together, sometimes the crush ribs 826 are substantially compressed and/or deformed, such that the excess material of the compression/deformation is able to fit into the troughs 844. Where the compression/deformation causes a smaller interference, there may be less excess material, rendering the troughs 844 unused. The endbell portion 810 thus offers additional flexibility for the assembly of the fuse assembly 500. The mating elements of the novel fuse assembly 500, different from those of the fuse assembly 100, also provide both secure affixation of the endbells to the fuse body and provide positioning guidance during assembly for ease of manufacturing the fuse assembly.

Figure 9B:
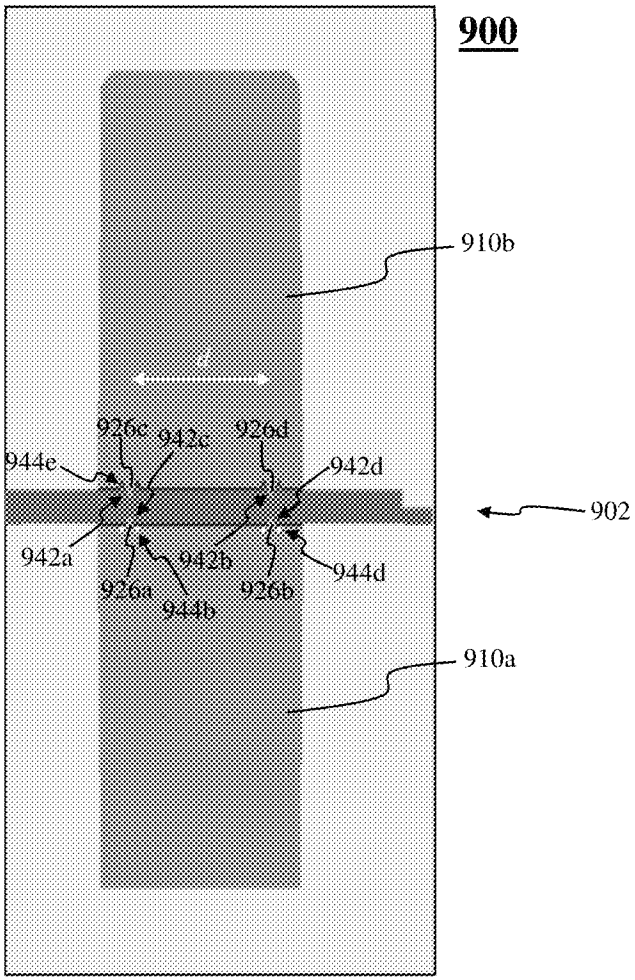
FIGS. 9A and 9B are diagrams illustrating endbell portions for the fuse assembly of FIG. 5, in accordance with exemplary embodiments.
Figure 9A:
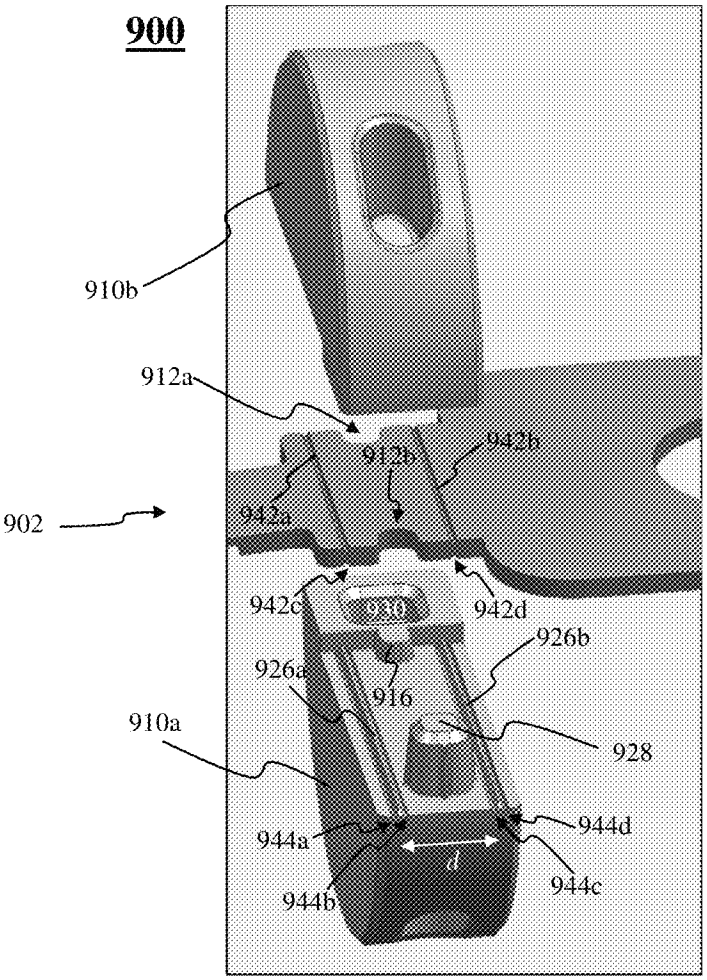

FIGS. 9A and 9B are representative drawings of endbell portion coupling 900, according to exemplary embodiments. FIG. 9A is a perspective view and FIG. 9B is a cross-sectional view of the endbell portion coupling 900. A terminal assembly 902 is shown disposed between a first endbell portion 910*a* and a second endbell portion 910*b* (collectively, "endbell portions 910"). The elements shown in FIGS. 9A and 9B may be part of the fuse assembly 500 (FIG. 5). The second endbell portion 910*b*, though showing fewer features, is substantially similar to the first endbell portion 910*a*, in exemplary embodiments. The terminal assembly 902 shares some similarities to the aforementioned terminal assemblies 200 and 600 and the endbell portions 910 share some similarities to the aforementioned endbell portions 610 and 810.

The endbell portions 910 feature both a protrusion 928 and a receptacle 930. The protrusion 928 of one endbell portion 910 is designed to fit into the receptacle of a second endbell portion. The terminal assembly 902 features a recess 912*a* and a recess 912*b* (collectively, "recesses 912"), which are disposed on opposing edges of the terminal assembly. The bottom endbell portion 910*a* shows a projection 916, and the endbell portion 910*b*, which is substantially similar to endbell portion 910*a*, also includes a projection. These projections 916 are designed to mate with respective recesses 912 of the terminal assembly 902, in exemplary embodiments. When the two endbell portions 910 are engaged with one another, the projection 916 of the endbell portion 910*a* will fit into the recess 912*a*, with the recess (not shown) of the endbell portion 912*b* fitting into the recess 912*b*.

In exemplary embodiments, the endbell portion 910*a* further includes a pair of crush ribs 926*a* and 926*b* (collectively, "crush ribs 926"). On either side of each crush rib 926 are troughs. Thus, crush rib 926*a* is disposed on either side of trough 944*a* and 944*b*, while crush rib 926*b* is disposed on either side of trough 944*c* and 944*d* (collectively, "troughs 944"). When the endbell portions 910 are engaged with one another, sometimes the crush ribs 926 are substantially compressed and/or deformed, such that the excess material of the compression/deformation is able to fit into the troughs 944, whether to one side of the crush rib, to a second side of the crush rib, or to both sides of the crush rib. Where the compression/deformation causes a smaller interference, there may be less excess material, rendering one or more of the troughs 944 unused.

In exemplary embodiments, the terminal assembly 902 includes mating grooves for coupling with the crush ribs 926 of the endbell portions 910. On a first surface of the terminal assembly 902, a first mating groove 942*a* is in one side of the recesses 912 and a second mating groove 942*b* is in another side of the recesses; on a second surface of the terminal assembly, a third mating groove 942*c* is in one side of the recesses and a second mating groove 942*d* is in another side of the recesses (collectively, "mating grooves 942"). In exemplary embodiments, the mating grooves 942 are spaced a distance, d, apart and the crush ribs 926 are also spaced a distance, d, apart. The mating grooves 942 of the terminal assembly 902 are thus receiving structures for mating with the crush ribs 926 of the endbell portions 910.

The terminal assembly 902, which may be made from copper or copper alloy, is pressed firmly against the zinc or zinc alloy material of the endbell portions 910, such that some compression and possibly deformation of the two materials occurs. In an exemplary embodiment, the pressure of connecting the crush ribs 926 against respective mating grooves 942 of the terminal assembly 910 produces a sealed envelope between the contents of the fuse assembly and the external environment. The crush ribs 926 and the mating grooves 942 facilitate melding of the respective components together, resulting in an air-tight coupling into the endbells without use of adhesive. The recesses 912 and projections 916 similarly help seal the endbell portions 910 against the terminal assembly 902.

In exemplary embodiments, the projection 916 of the endbell portions 910 and the recesses 912 of the terminal assembly 902 provide positioning guidance during manufacture of the fuse assembly 500. With the addition of mating grooves 942 in the terminal assembly 902, this positioning guidance is enhanced, in exemplary embodiments, as the crush ribs 926 of the endbell portions 910 are able to "find" the mating grooves of the terminal assembly 902 for ease of manufacturing the fuse assembly.

Insertion Pin Slots

The fuse assemblies described above feature insertion pins, which are used to secure the endbells to the fuse body. In legacy fuse assemblies, cylindrical holes are drilled into both the endbells and the fuse body. The holes retain the endbells axially within the cylindrical tube of the fuse body.

Figure 10:
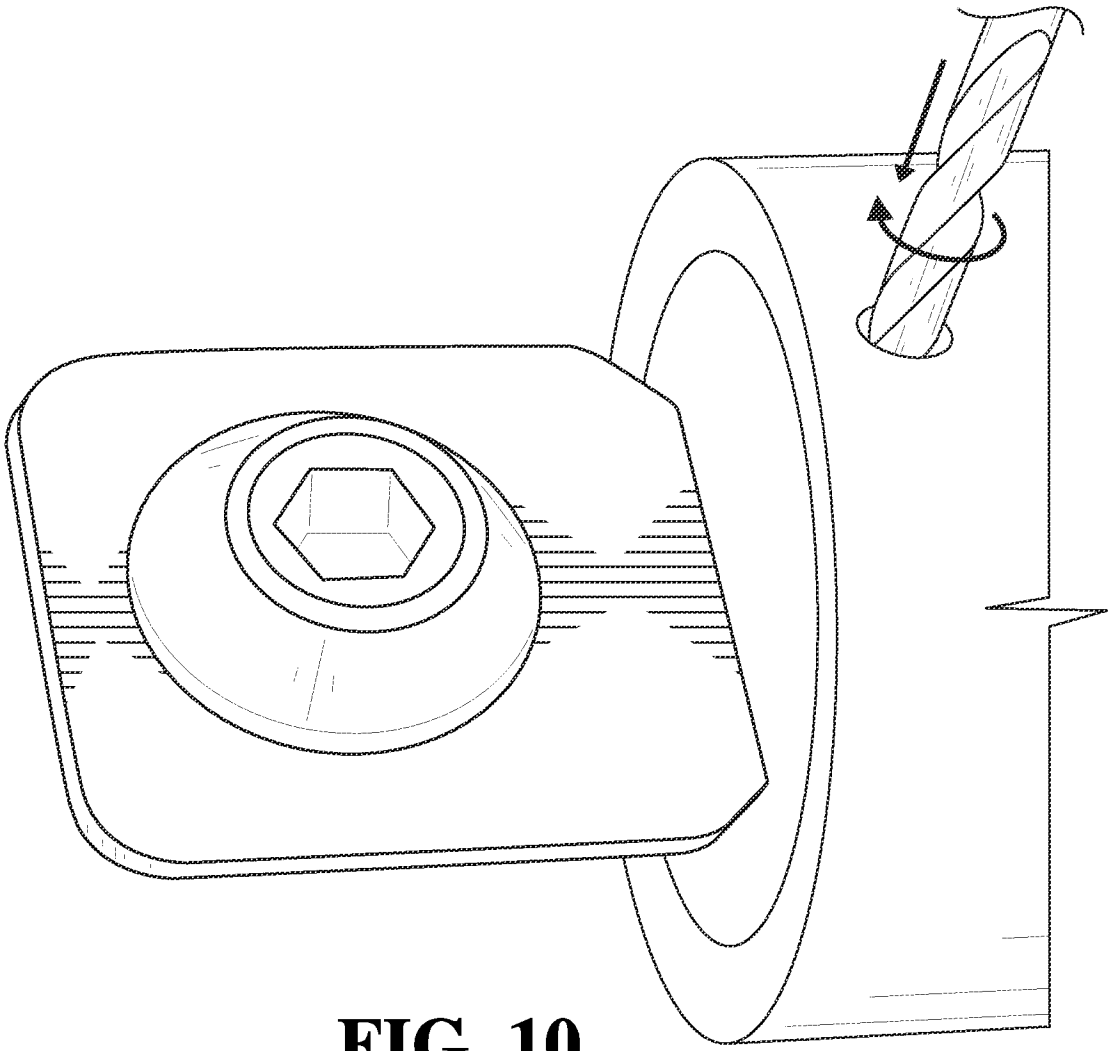
FIG. 10 (prior art)
FIG. 10 is a diagram illustrating fuse assembly drilling, in accordance with the prior art.

FIG. 10 is an illustration of a legacy drilling process of a fuse assembly according to the prior art. The drilling operation can be quite messy and may cause contamination inside the fuse assembly, which can negatively impact operation of the fuse element. For example, conductive materials from the drilling operation, if left inside the fuse assembly, may cause current to flow between the two terminals, even though the fuse element has been broken due to a fault condition. The material from the drilling operation may thus cause the fuse to not function as designed.

To retain the endbells at opposing ends of the fuse, holes are to be drilled radially to a specified depth through the fuse body and into the endbells. Metal pins are then inserted into the holes, rigidly retaining the endbells in place. Drilling into most fuse body materials is fast, efficient, and does not easily dull the drill bit. Drilling a blind hole into the endbell portion is risky because there is uncertainty about whether the drill hole is in the correct location. Further, drilling a blind hole into zinc is difficult, slow, and dulls the drill bit quickly and damages the drill bit with high regularity, which poses a problem for mass production. Because they are made from zinc or zinc alloy, drilling holes in the endbell portions 210, 610, or 910 is problematic, in some embodiments.

As an alternative to drilling, the endbell portions may be made using molding operations, such as injection molding. The core and cavity are the shaped sections in either half of the mold tool that give the endbell portion its final shape. The cylindrical holes used for the insertion pins can be molded in this way.

Figure 11A:
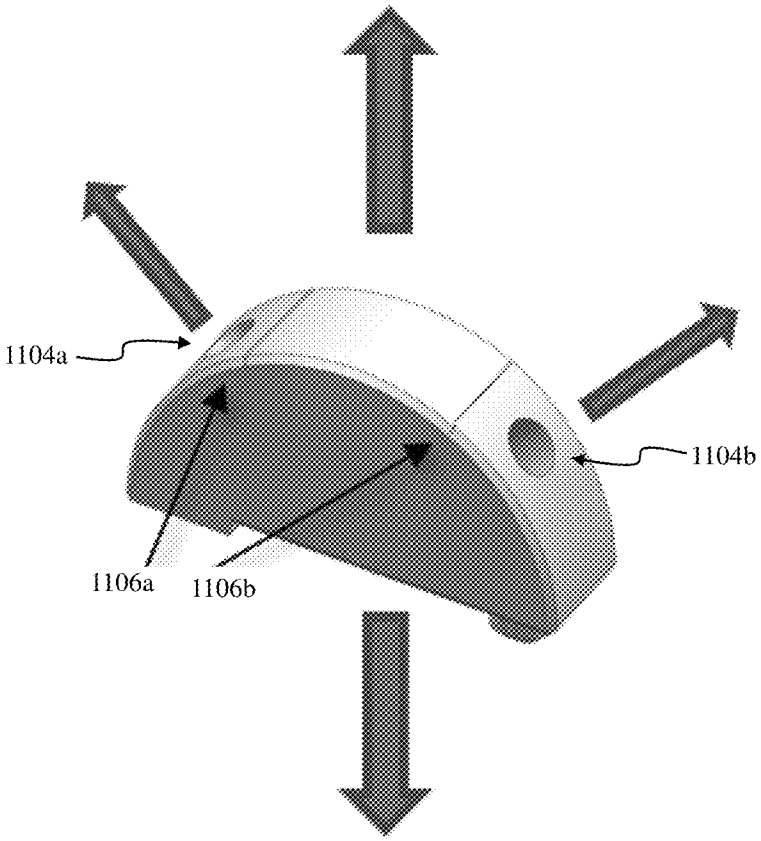
FIG. 11A is a diagram illustrating an endbell portion with cylindrical holes, in accordance with exemplary embodiments.

There may be drawbacks with using molding operations for the cylindrical holes, however. FIG. 11A is a representative drawing of an endbell portion with cylindrical holes, in accordance with exemplary embodiments. Endbell portion 1100 may be similar to endbell portions 210 of fuse assembly 100 or endbell portions 610 or 910 of fuse assembly 500. Two cylindrical holes 1104*a* and 1104*b* are shown, radially disposed in the circumferential edge of the endbell portion 1100, forming radial cavities (collectively, "holes 1104").

The upward vertical arrow indicates tool cavity pull while the downward vertical arrow indicates tool core pull of the molding operation. The diagonal arrows indicate tooling slide for the holes 1104. Unfortunately, during the tooling of the holes 1104, an interrupted surface profile, given by parting lines 1106*a* and 1106*b*, adds risk for consistent assembly to the fuse body.

Adding diecast/molded holes (as opposed to slots) require additional slides to be added to the tool, which in turn create an inconsistent surface due to the additional parting-lines. As this is the mating surface between the endbell exterior and the body interior, a consistent surface for the endbell is preferred. FIG. 11A thus shows an inefficient tooling layout. The diagonal lines indicate tooling "slides" that are not aligned with the tool pulling direction, which adds both cost and additional parting lines to the final part.

As an alternative, in exemplary embodiments, the endbells are formed in a molding operation with slots, rather than cylindrical holes. The slots are designed specifically to eliminate the need to add side actions in the molding tool and maintain a smooth uninterrupted endbell surface.

Figure 11B:
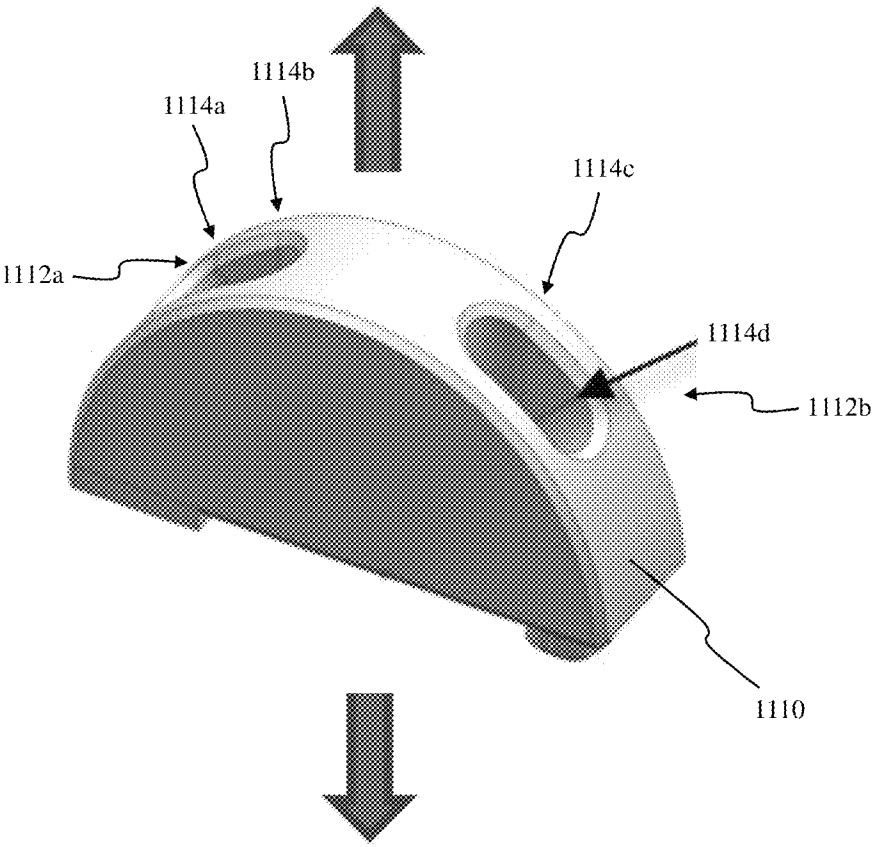
FIG. 11B is a diagram illustrating an endbell portion with slots, in accordance with exemplary embodiments.

FIG. 11B is a representative drawing of an endbell portion having slots 1150, in accordance with exemplary embodiments. Using a molding operation rather than drilling, two slots 1112*a* and 1112*b* are formed radially into the circumferential edge of the endbell portion 1150 (e.g., the semi-circular surface), forming radial cavities (collectively, "slots 1112"). Again, the upward vertical arrow indicates tool cavity pull while the downward vertical arrow indicates tool core pull. Unlike the holes 1012, the slots 1112 allow for direct pull direction from the tool cavity. In some embodiments, added slots are designed specifically to eliminate the need to add side actions in the molding tool and maintain a smooth uninterrupted endbell surface. In exemplary embodiments, the non-conductive material making up the fuse, such as fuse body 106 (FIG. 1) and fuse body 506 (FIG. 5), are also made using a molding process with the holes being part of the core and cavity of the fuse body, thus eliminating the need to drill holes in the fuse body.

Parting lines 1114*a* and 1114*b* are shown in slot 1112*a* and parting lines 1114*c* and 1114*d* are shown in slot 1112*b* (collectively, "parting lines 1114"). In contrast to the parting lines 1106 in FIG. 11A, the parting lines 1114 of endbell 1110 do not affect the surface of the endbell, but only the slots themselves, which will receive insertion pins during assembly. The alternative molding operation of FIG. 11B thus ensures a consistent minimally interrupted surface profile for improved assembly to the fuse body, in some embodiments. FIG. 11B thus shows the improved tooling layout, relative to that of FIG. 11A, in exemplary embodiments. By using slots rather than cylindrical holes, the slots are produced by tooling with the same pull direction as the rest of the tool.

Fuse Assembly 1200

Figure 12:
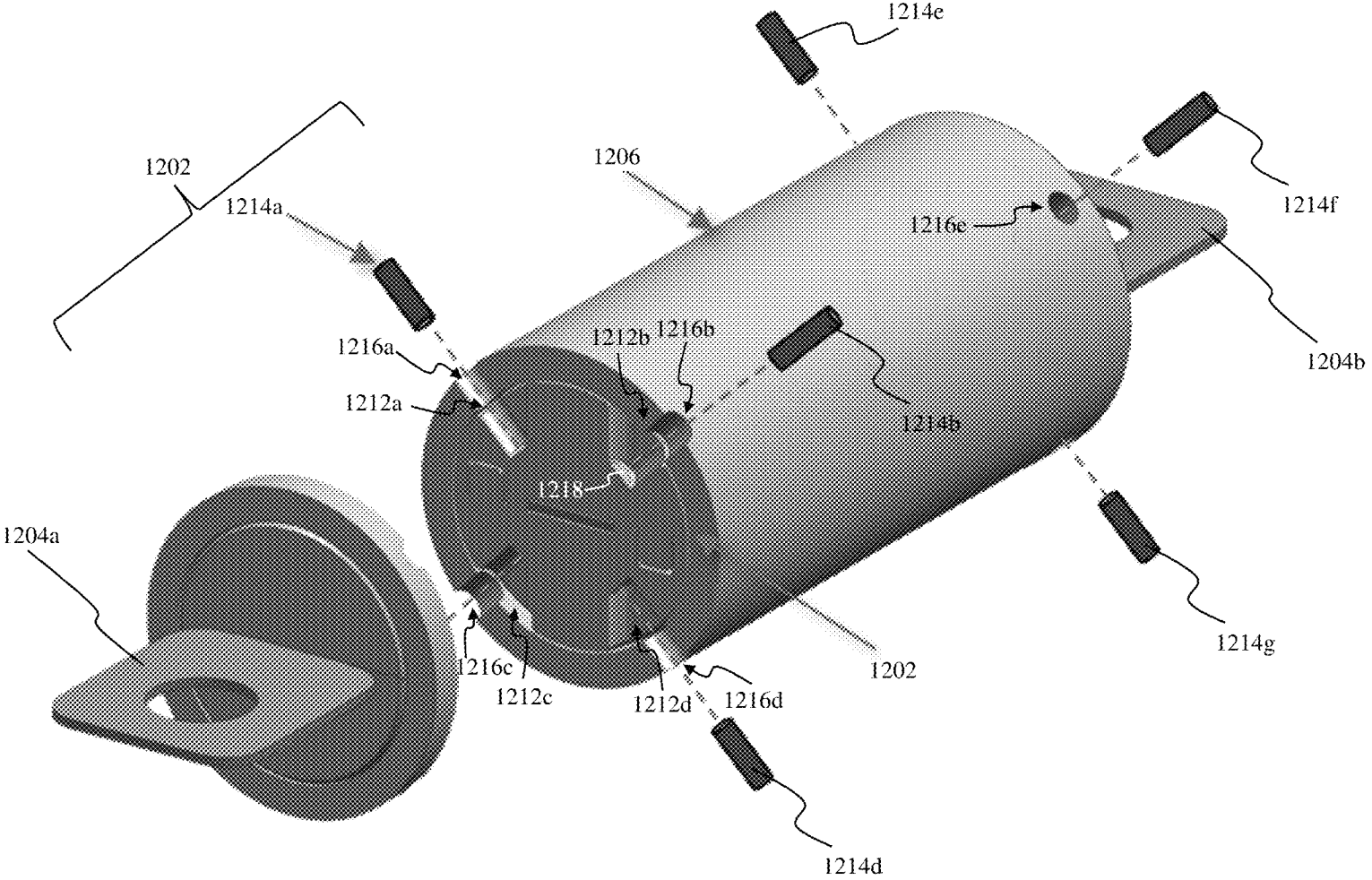
FIG. 12 is a diagram illustrating a fuse assembly, in accordance with exemplary embodiments.

FIG. 12 is a representative exploded perspective drawing of a fuse assembly 1200 featuring endbells with pre-molded alignment slots, according to exemplary embodiments. A fuse body 1206 and a cross-section of a single endbell 1202 are shown. The endbell 1202 may be a two-part endbell, such as the endbells 102 and 502 of the fuse assemblies 100 and 500, respectively. Fuse terminals 1204*a* and 1204*b* are shown at either end of the fuse body 1206.

The fuse body 1206 includes fuse body holes 1216*a*, 1216*b*, 1216*c*, and 1216*d*, shown in the cross-section of the endbell 1202, as well as fuse body hole 1216*e*, shown on the opposing side of the fuse body, for securing a second endbell (not shown) (collectively "fuse body holes 1216").

In exemplary embodiments, diecast/molded slots of predetermined size and orientation are located on each endbell 1202, removing the need to drill. Alignment slots 1212*a*, 1212*b*, 1212*c*, and 1212*d* are pre-molded into the circumferential surface of the endbell 1202, such as is shown in FIG. 11B (collectively, "alignment slots 1212" or "slots 1212"). The cross-sectional view shows that the slots 1212 are somewhat trapezoid-shaped, with the top of the slots near the circumferential surface of the endbell 1202 being wider than at the bottom, in some embodiments. Visible in the alignment slot 1212*b*, a slot bottom 1218 is circular, in some embodiments, though shown as a semi-circle in the cross-sectional view.

Also featured in the fuse assembly 1200 are insertion pins 1214*a*, 1214*b*, and 1214*d* for securing the endbell 1202 as well as insertion pins 1214*e*, 1214*f*, and 1214*g*, for securing the second unshown endbell (collectively, "insertion pins 1214"). Not visible insertion pins 1214 are presumed to be insertable in the fuse body hole 1216*c* and slot 1212*c* for the endbell 1202 and for the not visible endbell. In one embodiment, the insertion pins 1214 are made of a metal or metal alloy material, such as stainless steel. In an exemplary embodiment, four insertion pins 1214 are used to secure each endbell, though the number of insertion pins may vary.

Together, the fuse body holes 1216 and the slots 1212 receive the insertion pins 1214 to secure the endbell 1202 and not visible endbell to the fuse body 1206. The pre-cast/pre-molded alignment slots 1212 significantly simplify the fuse manufacturing process by removing the need to drill into the fuse endbells without adding tooling complexity. Using slots 1212 in the endbells 1202 (rather than cylindrical holes) allow the endbell tooling to remain basic with simple core/cavity blocks, avoiding costly side-action features in the tooling. The use of slots thus minimally impacts tooling cost and piece part cycle time, in some embodiments. Further, having pre-cast/pre-molded endbell slots allow for the fuse body to be independently drilled prior to assembly.

Further, in exemplary embodiments, the presence of the pre-cast/pre-molded alignment slots 1212 eliminates the risk of metal particulate entering the functional region of the fuse due to endbell drilling. The endbell slot design of FIG. 12 both guides pin insertion alignment and permits the action of drilling holes into the fuse body to be performed at any time separately from the rest of the assembly, in exemplary embodiments.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations, and changes to the described embodiments are possible without departing from the sphere and scope of the present disclosure, as defined in the appended claims. Accordingly, it is intended that the present disclosure not be limited to the described embodiments, but that it has the full scope defined by the language of the following claims, and equivalents thereof.

The invention claimed is:

1. A fuse assembly comprising:

a fuse body;

a terminal assembly disposed within the fuse body and having first and second opposing surfaces, the terminal assembly comprising a fuse element extending between a first terminal and a second terminal;

an endbell to be coupled to the fuse body, the endbell comprising:

a first endbell portion having a first crush rib engaging the first surface of the terminal assembly; and a second endbell portion having a second crush rib engaging the second surface of the terminal assembly, the first endbell portion and the second endbell portion being fastened to one another with the terminal assembly sandwiched therebetween, the first crush rib and the second crush rib forming a seal around the terminal assembly.

2. The fuse assembly of claim 1, wherein the first endbell portion further comprises:

a first receptacle formed therein; and a first protrusion extending therefrom, and the second endbell comprises a second receptacle formed therein and a second protrusion extending therefrom, wherein the first protrusion matingly engages the second receptacle and the second protrusion matingly engages the first receptacle.

3. The fuse assembly of claim 1, further comprising:

a first slot formed in a circumferential edge of the first endbell portion;

a second slot formed in a circumferential edge of the second endbell portion;

a first hole formed in the fuse body;

a second hole formed in the fuse body;

a first insertion pin extending through the first hole and the first slot; and a second insertion pin extending through the second hole and the second slot;

wherein the first and second insertion pins secure the endbell to the fuse body.

4. The fuse assembly of claim 2, wherein the first crush rib is disposed on surface of the first endbell portion intermediate the first receptacle and the first protrusion.

5. The fuse assembly of claim 1, wherein the first endbell portion is identical to the second endbell portion.

6. The fuse assembly of claim 1, wherein the endbell is formed of a zinc alloy material.

7. The fuse assembly of claim 1, wherein the first crush rib is deformed into the first surface and the second crush rib is deformed into the second surface to form an air-tight seal between the first endbell portion, the terminal assembly, and the second endbell portion.

8. The fuse assembly of claim 1, further comprising:

first and second mating grooves in the first surface of the terminal assembly;

third and fourth mating grooves in the second surface of the terminal assembly;

a third crush rib on the first endbell portion; and a fourth crush rib on the second endbell portion;

wherein the first crush rib mates with the first mating groove, the second crush rib mates with the second mating groove, the third crush rib mates with the third mating groove and the fourth crush rib mates with the fourth mating groove.

9. The fuse assembly of claim 8, the first endbell portion further comprising:

a first feature surface comprising a first raised portion and a first protrusion, the first raised portion defining a first receptacle.

10. The fuse assembly of claim 9, the second endbell portion further comprising a second feature surface comprising a second raised portion and a second protrusion, the second raised portion defining a second receptacle, wherein the second protrusion engages the first receptacle and the first protrusion engages the second receptacle in response to the first endbell portion being fastened to the second endbell portion.

11. The fuse assembly of claim 10, further comprising a plurality of troughs disposed adjacent to respective crush ribs for allowing excess material from each crush rib to flow into a respective trough in when the first endbell portion is fastened to the second endbell portion.

12. An endbell adapted to secure a terminal assembly within a fuse body, the endbell comprising:

a first endbell portion comprising a first protrusion, a first receptacle, and a first crush rib, wherein the first crush rib is adapted to engage a first surface of the terminal assembly; and a second endbell portion comprising a second protrusion, a second receptacle, and a second crush rib, wherein the second crush rib is adapted to engage a second surface of the terminal assembly opposite the first surface;

wherein the first protrusion engages the second receptacle and the second protrusion engages the first receptacle to form a seal around the terminal assembly.

13. The endbell of claim 12, further comprising:

a first lip seat formed on the first protrusion; and a second lip seat formed on the second protrusion;

wherein a first lip of the terminal assembly is formed on the first lip seat and a second lip of the terminal assembly is formed on the second lip seat.

14. The endbell of claim 13, the first protrusion further comprising a first lip seat and the second protrusion further comprising a second lip seat, wherein a first lip of the terminal assembly mates with the first lip seat and a second lip of the terminal assembly mates with the second lip seat in response to the first endbell portion being fastened to the second endbell portion.

15. The endbell of claim 12, the first endbell portion further comprising:

a feature surface having a raised portion; and a third crush rib, wherein the first crush rib is formed on an edge of the feature surface and the third crush rib is formed on a second edge of the feature surface;

wherein the first protrusion is disposed on the feature surface and the first receptacle is disposed on the raised portion.

16. The endbell of claim 15, wherein a projection extends from the raised portion, the projection to mate with a recess of the terminal assembly.

17. The endbell of claim 12, further comprising:

a first slot formed in a circumferential edge of the first endbell portion;

a second slot formed in a second circumferential edge of the second endbell portion;

wherein a first insertion pin is inserted into a first cylindrical hole of a fuse body and the first slot and a second insertion pin is inserted into a second cylindrical hole of the fuse body and the second slot to secure the endbell to the fuse body.

18. A fuse assembly comprising:

a fuse body comprising a first hole and a second hole, wherein the fuse body is molded with the first and second holes;

a first endbell portion molded with a first slot, wherein the first slot is formed radially into a circumferential edge of the first endbell portion forming a radial cavity therethrough;

a second endbell portion molded with a second slot, wherein the second slot is formed radially into a circumferential edge of the second endbell portion forming a radial cavity therethrough; and a first insertion pin extending through the first hole and the first slot; and a second insertion pin extending through the second hole and the second slot;

wherein the first and second insertion pins secure the first and second endbell portions to the fuse body.

19. The fuse assembly of claim 18, further comprising a terminal assembly disposed within the fuse body, the terminal assembly comprising a fuse element extending between a first terminal and a second terminal, wherein the first endbell portion and the second endbell portion are fastened to one another with the terminal assembly sandwiched therebetween, the first endbell and the second endbell forming a seal around the terminal assembly.

* * * * *